US005329062A

United States Patent [19]

Kaneko

[11] Patent Number: 5,329,062

[45] Date of Patent: Jul. 12, 1994

[54] METHOD OF RECORDING/REPRODUCING WAVEFORM AND APPARATUS FOR REPRODUCING WAVEFORM

[75] Inventor: Youji Kaneko, Kokubunji, Japan

[73] Assignee: Casio Computer Co., Ltd., Tokyo, Japan

[21] Appl. No.: 732,508

[22] Filed: Jul. 18, 1991

[30] Foreign Application Priority Data

Jul. 31, 1990 [JP] Japan ..... 2-201358
Jul. 31, 1990 [JP] Japan ..... 2-201359
Jul. 31, 1990 [JP] Japan ..... 2-201360

[51] Int. Cl.[5] ..... G10H 7/02

[52] U.S. Cl. ..... 84/603; 84/DIG. 9; 84/604

[58] Field of Search ..... 341/61, 77, 122, 123; 381/29-32; 84/601-607, 622, 624, 659, 661, 735, 736, DIG. 9

[56] References Cited

U.S. PATENT DOCUMENTS 4,070,708 1/1978 Smallcombe et al. ..... 364/575
4,166,981 9/1979 Marchasson et al. ..... 330/52
4,182,993 1/1980 Tyler ..... 330/279
4,503,510 3/1985 Weaver ..... 364/715
4,539,526 9/1985 Davis ..... 330/144
4,665,436 5/1987 Osborne et al. ..... 358/136
4,691,608 9/1987 Sasaki et al. ..... 84/603
4,916,996 4/1990 Suzuki et al. ..... 84/603
4,972,164 11/1990 Akagiri et al. ..... 333/14
5,025,471 6/1991 Scott et al. ..... 381/43
5,086,439 2/1992 Asai et al. ..... 375/122
5,089,820 2/1992 Gorai et al. ..... 84/603 P

OTHER PUBLICATIONS

Lapedes, "Dictionary of Scientific and Technical Terms", McGraw Hill Book Company, 1976, p. 307.

*Primary Examiner*—William M. Shoop, Jr.
*Assistant Examiner*—Brian Sircus
*Attorney, Agent, or Firm*—Frishauf, Holtz, Goodman & Woodward

[57] ABSTRACT

A digital audio signal prerecorded in a DAT is processed by a computer to calculate a compressed difference data array. This compressed difference data array is obtained by compression processing on the basis of a variable compression ratio depending on the magnitude of the variation of the original waveform data array. This compressed difference data array is written in a ROM as waveform data for musical tone generation, and the ROM which stores the waveform data is used as a circuit arrangement for an electronic musical instrument. The electronic musical instrument expands the compressed difference data array on the basis of expansion ratio data, and reproduces it as a waveform data array. This waveform data array is audibly output as a musical tone signal.

19 Claims, 15 Drawing Sheets

METHOD OF RECORDING/REPRODUCING WAVEFORM AND APPARATUS FOR REPRODUCING WAVEFORM

BACKGROUND OF THE INVENTION

1. Field of the Invention

The present invention relates to a technique for recording an original audio signal obtained from a conventional acoustic musical instrument as a digital waveform data array and reproducing the recorded data array.

2. Description of the Related Art

In the field of electronic musical instruments, a sound source called a PCM sound source incorporates a waveform memory for storing musical tone data as waveform data (PCM data) arrays.

In operation, the PCM sound source reads out waveform data from the waveform memory at a speed corresponding to a required pitch to produce a musical tone signal having a desired pitch.

This PCM sound source disadvantageously requires a large-capacity memory as a waveform memory. In order to eliminate this drawback, a differential PCM (DPCM) scheme is available. According to the DPCM scheme, in an expectation that the number of bits required to express a difference value between adjacent waveform data is smaller than the number of bits required to express each waveform data, a difference value data array (difference data array) is recorded in place of each waveform data array. At the time of reproduction, a DPCM sound source accumulates difference data read out from the difference data array memory to reproduce waveform data.

Reproduction precision in a conventional DPCM scheme undesirably varies depending on tone colors and the like of original audio signals.

In the conventional DPCM scheme, a waveform data array {x(n)} having a given number of bits (e.g., 16 bits) is converted into a difference data array {d(n)} having the number of bits (e.g., 8 bits) smaller than that of the waveform data array {x(n)}. The basic principle of conversion will be described below. First, the difference between adjacent waveform data x(k) and x(k−1) is calculated as follows:

$$x(k)-x(k-1)=Dx \tag{1}$$

The difference Dx is difference data expressed by 16 bits. When the magnitude of the difference data Dx can be represented by 8 bits (i.e., −128 to 127), the lower 8 bits of 16-bit difference data Dx are defined as kth 8-bit difference data d(x).

For example, if the difference data Dk is represented by

0000000001000000, then, d(x) is given as

01000000.

In this case, a two's complement is assumed. When the magnitude of the Dx represents a value which cannot be expressed by eight bits, the data d(k) is clipped to a maximum value which can be expressed by eight bits.

For example, if Dx is 0000100000000000 (2048 in decimal notation), d(k) is clipped to an 8-bit maximum positive value as follows:

01111111 (127 in decimal notation).

In order to reduce an accumulation error caused by clipping, the following equation is calculated in practice in place of equation (1):

$$x(k)-\sum_{i=0}^{k-1} d(i) = dx \tag{2}$$

so that 16-bit difference data dx is converted into 8-bit difference data d(x).

Waveform distortion occurs in a waveform reproduced from the difference data array {(d(n)} due to the above clipping. In addition to this drawback, the frequency of occurrence of clipping, which causes a decrease in S/N ratio, depends on the waveform data array {x(n)} and hence the spectrum or tone color of an original tone to be recorded. As a result, the conventional DPCM scheme cannot guarantee desired reproduction fidelity or precision due to variations in S/N ratio caused depending on the kinds of original audio signals.

The above differential PCM scheme is called a linear differential PCM scheme. Clipping occurring in the linear differential PCM scheme can be eliminated by using a technique called a non-linear differential PCM scheme. In the non-linear DPCM scheme, in the recording mode, a waveform data array is converted into a nonlinear difference data array having a limited number of bits in accordance with a predetermined non-linear function (e.g., a logarithmic function). In the reproduction mode, a waveform data array is reproduced from a non-linear difference data array in accordance with a reverse function (e.g., an exponential function) of the non-linear function. When a non-linear DPCM scheme of this type is used, a relatively large linear difference value of a waveform data array can be converted into non-linear difference data having a smaller number of significant bits by non-linear conversion.

Even if a non-linear DPCM scheme is used, however, variations occur in the S/N ratio or reproducibility accordance with the kinds of original audio signals or tones. For example, in a logarithmic difference data array is changed by the kinds (i.e., magnitudes of variations in waveform data array) of original tones. For example, in a logarithmic DPCM scheme, reproducibility of a portion of the waveform data array having a small variation is adversely affected depending on the kinds of original tones.

In addition, in a sound source using a waveform data memory for storing a waveform data array or a difference data array, the reproduced waveform data array is not directly output. The reproduced waveform data array is often digitally filtered to generate a processed waveform data array so as to obtain a desired tone color or the like. A sound source (waveform generation apparatus) of this type requires high-speed data processing. When a waveform reproduction technique for assuring desired reproduction precision is applied to a waveform generation apparatus of this type, a complicated arrangement of the waveform generation apparatus and reduction in data processing speed are desirably prevented.

SUMMARY OF THE INVENTION

The present invention has been made in consideration of the above situation, and has as its principal object to provide a method of recording/reproducing a waveform and an apparatus therefor, wherein a waveform data is recorded with a data array having a limited number of bits such that waveform distortion of an audio signal can be minimized, and a high-quality waveform having a minimum distortion can be reproduced from a recorded data array.

It is another object of the present invention to provide a simple waveform generation apparatus capable of reproducing a high-quality waveform data array from a data array having a relatively small number of bits regardless of the types of waveforms, and performing desired processing of the waveform data array.

According to an aspect of the present invention, there is provided a method of recording/reproducing a waveform, comprising the steps of preparing a waveform data array representing an audio signal, forming a compressed difference data array from the waveform data array on the basis of a scaling ratio variable depending on a magnitude of a variation of the waveform data array, storing the compressed difference data array, storing expansion ratio data representing an expansion ratio associated with the scaling ratio, and reproducing a waveform data array from the stored compressed difference data array on the basis of the stored expansion ratio data.

The basic feature of the above method lies in that the scaling and expansion ratios are taken into consideration in waveform recording and reproduction, and the magnitudes of the scaling and expansion ratios are determined in accordance with variations in waveform data of the waveform data array, and hence with a spectrum or tone color of an audio signal. In the conventional DPCM scheme, lower N bits of the difference between adjacent waveform data are recorded as difference data in the recording mode, and the difference data are accumulated to reproduce the waveform data in the reproduction mode. The conventional DPCM scheme does not have a concept of difference data scaling and its expansion. For this reason, when the difference between adjacent waveform data is large (i.e, when a variation in waveform data array is large), decisive distortion occurs.

To the contrary, according to the above aspect of the present invention, when a variation in waveform data array is large, a corresponding scaling ratio is set, and the difference data array is recorded at this corresponding scaling ratio. In the reproduction mode, an accumulation output of difference data expanded by the expansion ratio (i.e., a reciprocal value of the scaling ratio or a value close to it) associated with the scaling ratio is reproduced as waveform data in the reproduction mode.

The magnitude of variations in waveform data arrays can be evaluated in accordance with various techniques. For example, the magnitude of variation in waveform data array can be evaluated in accordance with the maximum value of the difference between adjacent waveform data. A scaling ratio can be determined on the basis of the maximum value of the difference as a reference value. For example, if a scaling ratio is determined so that the maximum difference is converted into an N-bit maximum value in a compressed difference data array, no clipping occurs. A scaling ratio without any clipping does not necessarily provide maximum tone quality of reproduced waveform data. When waveform data is recorded at a scaling ratio without any clipping and is reproduced at an expansion ratio as a reciprocal value of the scaling ratio, reproducibility can be improved at a portion where a waveform steeply varies. However, reproducibility is degraded at a portion where a waveform variation is small. To the contrary, when waveform data is recorded at a scaling ratio slightly smaller than the scaling ratio without any clipping and is reproduced at a corresponding expansion ratio, reproducibility is degraded at a portion where a waveform steeply varies. However, reproducibility is improved at a portion where a waveform variation is small. Waveform data is recorded and reproduced at several scaling ratios and corresponding expansion ratios by using a compression scaling ratio without any clipping as a reference, and an optimal auditory scaling ratio and a corresponding expansion ratio are preferably determined (i.e., subjective evaluation of variations in waveform data in an auditory test).

An array of the differences between adjacent waveform data in each waveform data array may be statistically processed to obtain waveform variation feature parameters to objectively evaluate the magnitude of variation in the waveform data array. According to the waveform recording/reproducing method of the present invention, original waveform data can be compressed at a high fidelity and recorded by a data array having a limited number of bits, and a high-quality waveform can be reproduced.

A waveform reproduction apparatus for reproducing the waveform data recorded in accordance with the above waveform recording/reproducing method comprises compressed difference data array memory means for storing a compressed difference data array compressed at a compression ratio depending on a magnitude of a variation of a waveform data array representing an audio signal, expansion ratio data memory means for storing expansion ratio data representing an expansion ratio associated with the scaling ratio, and means for reproducing a waveform data array representing the audio signal on the basis of the compressed difference data array and the expansion ratio data.

The reproducing means can comprise means for accumulating compressed difference data arrays read out from the compressed difference data array memory means and forming an accumulation output, and means for multiplying the accumulation output from the accumulating means with the expansion ratio data.

Instead of multiplying the accumulation output with the expansion ratio data, each the compressed difference data may be multiplied with the expansion ratio data and the product may be accumulated. In fact, the reproducing means can be arbitrarily arranged to use the expansion ratio data as a multiplier in an appropriate stage of reproduction.

An envelope extraction step and a waveform normalization step may be incorporated as preprocessing steps in the waveform recording method of the present invention. More specifically, an envelope is extracted from a waveform data array representing an original audio signal, and the waveform data array is normalized by the extracted envelope, thereby forming a normalized waveform data array. The waveform recording method described above is applied to this normalized waveform data array. When a waveform is to be reproduced, a predetermined envelope (e.g., an extracted envelope) is generated, and a waveform is reproduced on the basis of this envelope, the stored compressed difference data and expansion ratio data.

By performing envelope extraction and waveform data array normalization by the extracted envelope, as described above, an S/N ratio of a portion having a small volume level (i.e., a tone attack portion and a decay portion) can be increased.

An arrangement of a waveform reproduction apparatus which employs the waveform recording/reproducing method of the present invention comprises compressed difference data array memory means for storing a compressed difference data array compressed at a compression scaling ratio depending on a magnitude of a variation of a normalized waveform data array normalized by an envelope of an audio signal, expansion ratio data memory means for storing expansion ratio data representing an expansion ratio associated with the compression scaling ratio, envelope generating means for generating a predetermined envelope, and means for reproducing a waveform data array on the basis of the compressed difference data array, the expansion ratio, and the envelope.

According to this arrangement, the reproducing means must perform two multiplications for reproducing one waveform data sample, i.e., an expansion ratio multiplication and an envelope multiplication.

Another arrangement of the waveform reproduction apparatus comprises compressed difference data array memory means for storing a compressed difference data array compressed at a scaling ratio depending on a magnitude of a variation of a normalized waveform data array normalized by an envelope of an audio signal, envelope generating means for generating an envelope expanded at an expansion ratio associated with the scaling ratio, means for accumulating compressed difference data arrays from the compressed difference data array memory means, and means for multiplying an accumulation output from the accumulating means with the envelope from the envelope generating means and reproducing a waveform data array.

In this arrangement, since the envelope generating means generates an envelope added with the expansion ratio, only one multiplication (an envelope multiplication) is performed for reproduction of one waveform data sample, thus reducing the number of multiplication steps.

It is desirable to generate various kinds of musical tones in a sound source for an electronic musical instrument. A waveform reproduction apparatus obtained by applying the present invention to a sound source of this type comprises difference data array memory means for storing a plurality of difference data arrays, scale factor memory means for storing a plurality of scale factors corresponding to the respective difference data arrays stored in the difference data array memory means, and means for reproducing the waveform data array representing an audio signal on the basis of the difference data array from the difference data array memory means and the scale factor from the scale factor memory means, the scale factor corresponding to this difference data array.

According to another aspect of the present invention, there is provided a method of recording/ reproducing a waveform, comprising the preparation step of preparing a waveform data array representing an audio signal, the compressed non-linear type difference data array generation step of generating a compressed non-linear type difference data array having a normalized range based on a predetermined non-linear function and a scaling ratio corresponding the waveform data array, the data array storage step of storing the compressed non-linear difference data array, the expansion ratio storage step of storing an expansion ratio associated with the scaling ratio, and the reproduction step of reproducing a waveform data array from the stored compressed non-linear difference data array on the basis of a reciprocal function of the non-linear function and the stored expansion ratio.

According to the basic feature of the above arrangement, in waveform recording and reproduction, a non-linear difference technique is utilized, the scaling and expansion ratios are taken into consideration, and the magnitudes of the scaling and expansion ratios are determined in accordance with the variation in waveform data in the waveform data array, and hence with the spectrum or tone color of the audio signal. In a conventional difference PCM scheme, whether it is a linear or non-linear scheme, the difference (linear or non-linear difference) between adjacent waveform data in the recording mode is recorded as difference data without data scaling. The difference data is converted into waveform data without expanding it. The conventional differential PCM scheme does not incorporate the concept of difference data scaling/expansion and cannot cope with various types of audio signals, thereby causing variations in reproducibility.

To the contrary, in the above arrangement of the present invention, when a variation in waveform data array is large, a corresponding scaling ratio is set, and a non-linear difference data array compressed at this scaling ratio is recorded. In the reproduction mode, an accumulation output of non-linear difference data expanded at the expansion ratio (i.e., a reciprocal value of the scaling ratio or a value close to it) associated with the scaling ratio is reproduced as the waveform data.

The above scaling and expansion operations can be performed within a data space (to be referred to as a linear space for illustrative convenience) prior to non-linear function conversion and a data space (to be referred to as a linear space for illustrative convenience) after conversion by a reverse function, respectively. In this case, the compressed non-linear difference data generation step comprises the steps of compressing the waveform data array in accordance with the scaling ratio and generating the compressed waveform data array whose range is normalized, and converting the compressed waveform data array into the compressed non-linear difference data array having a limited number of bits in accordance with the non-linear function. The reproduction step comprises the steps of converting the compressed non-linear difference data array into a reproduced compressed waveform data array in accordance with the reverse function, and expanding the reproduced compressed waveform data array in accordance with the expansion ratio to generate a reproduced waveform data array.

With the above arrangement, the entire ranges (full ranges) of the non-linear function conversion and reverse function conversion can be efficiently used to improve waveform reproducibility.

Alternatively, compression scaling and expansion processing operations can be performed within a data space (i.e., the non-linear space) between non-linear function conversion and reverse function conversion. In this case, the compressed non-linear difference data array generation step comprises the steps of changing the waveform data array into the non-linear difference data array in accordance with the non-linear function, and generating the compressed non-linear difference data array normalized with respect to a limited number of bits obtained by compressing the non-linear difference data array in accordance with the scaling ratio. The reproduction step comprises the steps of expanding the compressed non-linear difference data array in accordance with the expansion ratio to generate a reproduced non-linear difference data array, and converting the reproduced non-linear difference data array into a reproduced waveform data array in accordance with the reverse function.

In this case, since the information of the non-linear difference data array converted by the non-linear function is input to reverse function conversion processing without being lost by scaling processing using the scaling ratio depending on the waveform data array and expansion processing using the expansion ratio depending on the waveform data array, reproducibility better than that of the conventional non-linear difference PCM scheme can be obtained.

In addition, according to the present invention, as a waveform reproduction apparatus for practicing the above waveform reproduction method, there is provided a waveform reproduction apparatus comprising compressed non-linear difference data memory means for storing a compressed non-linear difference data array compressed by a scaling ratio depending on waveform data representing an audio signal and non-linearly converted in accordance with a predetermined non-linear function, expansion ratio memory means for storing an expansion ratio associated with the scaling ratio, and reproducing means for reproducing a waveform data array representing the audio signal from the compressed non-linear difference data array on the basis of a reverse function of the non-linear function and the expansion ratio.

The reproducing means can perform expansion processing within a linear or non-linear space.

The reproducing means for performing expansion processing within the linear space comprises means for converting the compressed non-linear difference data array into a reproduced compressed waveform data array in accordance with the reverse function, and means for expanding the reproduced compressed waveform data array in accordance with the expansion ratio to generate a reproduced waveform data array. On the other hand, the reproducing means for performing expansion processing within the non-linear space comprises means for expanding the compressed non-linear difference data array in accordance with the expansion ratio to generate a non-linear difference data array, and means for converting the non-linear difference data array into a waveform data array in accordance with the reverse function.

In addition, the method of recording/reproducing a waveform according to the present invention can include audio signal envelope extraction processing and normalization processing (envelope removal processing) using the extracted envelope as preprocessing operations in the recording system. This method comprises the preparation step of preparing a waveform data array representing an original audio signal, the envelope extraction step of extracting an envelope from the waveform data array, the normalization step of normalizing the waveform data array in accordance with the extracted envelope to generate a normalized waveform data array free from the envelope, the compressed non-linear difference data array generation step of generating a compressed non-linear difference data array from the normalized waveform data array on the basis of a predetermined non-linear function and a scaling ratio depending on the normalized waveform data array, the data array storage step of storing the compressed non-linear difference data array, the expansion ratio storage step of storing an expansion ratio associated with the scaling ratio, the envelope generation step of generating a predetermined envelope, and the reproduction step of reproducing a waveform data array from the stored compressed non-linear difference data array on the basis of a reverse function of the non-linear function, the stored expansion ratio, and the predetermined envelope.

As described above, since the envelope extraction and the waveform data array normalization (envelope removal processing) by using the extracted envelope are performed, an S/N ratio of a portion having a low volume level (i.e., a tone attack or decay portion) can be increased.

An arrangement of a waveform reproduction apparatus which employs the above waveform recording/reproduction method comprises compressed non-linear difference data array memory means for storing a compressed non-linear difference data array compressed at a scaling ratio depending on a normalized waveform data array representing an audio signal free from an envelope and non-linearly converted in accordance with a predetermined non-linear function, expansion ratio memory means for storing an expansion ratio associated with the scaling ratio, envelope generating means for generating a predetermined envelope, and reproducing means for reproducing a waveform data array from the compressed non-linear difference data array on the basis of a reverse function of the non-linear function, the expansion ratio, and the predetermined envelope.

In this arrangement, the reproducing means must perform two multiplications to reproduce one waveform data sample, i.e., an expansion ratio multiplication and an envelope multiplication.

Another arrangement of the waveform reproduction apparatus comprises compressed non-linear difference data array memory means for storing a compressed non-linear difference data array compressed at a scaling ratio depending on a normalized waveform data array representing an audio signal free from an envelope and non-linearly converted in accordance with a predetermined non-linear function, and waveform reproducing means for reproducing a waveform data array from the compressed non-linear difference data array. The waveform reproducing means comprises means for converting the compressed non-linear difference data array into a compressed normalized waveform data array in accordance with a reverse function of the non-linear function, envelope generating means for generating an envelope expanded at an expansion ratio associated with the scaling ratio, and means for multiplying the expanded envelope with the compressed normalized waveform data array.

In this arrangement, since the envelope generating means generates an envelope reflecting the expansion ratio, only one multiplication (envelope multiplication) is performed to reproduce one waveform data sample, thereby reducing the number of multiplications.

According to the present invention, in addition to the waveform reproduction by the above reproducing means, the present invention can be applied to a waveform generation apparatus including digital filter means for processing the reproduced waveform.

According to still another aspect of the present invention, there is provided a waveform generation apparatus comprising compressed difference data array memory means for storing a compressed difference data array compressed at a compression scaling ratio depending on a magnitude of a variation of a waveform data array representing an audio signal, waveform reproducing means for reading out the compressed difference data from the compressed difference data array memory means and reproducing the waveform data, digital filter means for performing digital filtering of the waveform data output from the waveform reproducing means, and scale factor memory means for storing a scale factor obtained by multiplying a gain coefficient associated with the filtering of the digital filtering means with an expansion ratio, associated with the compression scaling ratio, for normalizing a range of waveform data reproduced from the waveform reproducing means, the digital filter means including means for multiplying the scale factor from the scale factor memory means with the waveform data reproduced by the waveform reproducing means.

The first feature of this arrangement lies in that the waveform information stored in the memory means serving as a waveform information memory is expressed by the difference data array compressed at the compression scaling ratio depending on the magnitude of variation in the waveform data array representing the audio signal. The storage capacity of the waveform information memory (i.e., the compressed difference data array memory means) can be reduced. In order to reproduce an original waveform data array from the compressed difference data array, the compressed difference data are accumulated, and an accumulation output (i.e., the compressed reproduced waveform data) is multiplied with an expansion ratio (a reciprocal value of the compression scaling ratio or a value close thereto) associated with the compression ratio. Therefore, a high-quality waveform data array can be reproduced regardless of the kinds of waveforms.

The present invention employs a new concept of an expansion ratio, which has not been proposed in any prior art, so the expansion ratio must be multiplied with data to reproduce original waveform data. When this waveform reproduction technique is directly applied to a waveform generation apparatus having a digital filter function such as tone color processing, an expansion ratio multiplication for waveform reproduction (normalization) and filter gain coefficient multiplication for digital filtering must be independently performed to obtain one waveform data, thereby increasing the load of the waveform generation apparatus.

According to the second feature of the above arrangement, a scale factor corresponding to a value obtained by multiplying the expansion ratio with the filter gain coefficient is stored in the scale factor memory means. The digital filter means includes the means for multiplying the waveform data with the scale factor in place of the filter gain coefficient, thereby reducing the number of multiplications required for generating the waveform.

In addition, according to the present invention, there is provided a waveform generation apparatus comprising compressed difference data array memory means for storing a compressed difference data array compressed at a compression scaling ratio depending on a magnitude of a variation of a waveform data array representing an audio signal, scale factor memory means for storing a scale factor having a value obtained by multiplying a filter gain coefficient associated with digital filtering processing for tone color processing of the waveform data array with an expansion ratio, associated with the compression scaling ratio, for normalizing a range of the waveform data array for reproducing the waveform data array, and waveform generating means for processing the compressed difference data array from the compressed difference data array memory means to generate a tone-color-processed waveform data array so as to achieve reproduction of the waveform data array on the basis of the compressed difference data array and the expansion ratio and so as to achieve digital filtering processing having the filter gain coefficient for the waveform data array, the waveform generating means including multiplying means for simultaneously performing a multiplication of the expansion ratio for normalizing the range of the waveform data array and a multiplication of the filter gain coefficient associated with the digital filtering processing by means of one multiplication using the scale factor from the scale factor memory means as a multiplier.

In this case, the multiplying means may perform a multiplication in an appropriate processing step in signal processing of the waveform generating means, and the processing step is not limited to a specific one. In addition, the signal processing performed by the waveform generating means can have an arbitrary processing order if reproduction of desired waveform data and its processing (digital filter) are assured.

Other arrangements, modifications, and applications of the present invention can be made within the spirit and scope of the invention, as will be apparent to those skilled in the art from the detailed description of the preferred embodiments.

DETAILED DESCRIPTION OF THE PREFERRED EMBODIMENTS

Preferred embodiments of the present invention will be described in detail with reference to the accompanying drawings.

FIRST EMBODIMENT

Figure 1:
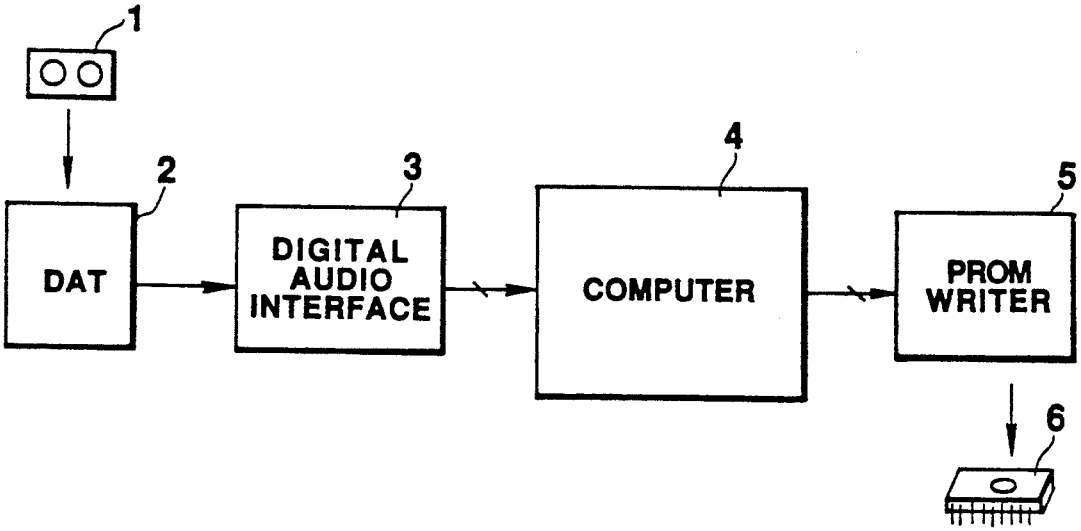
FIG. 1 is a block diagram showing an overall arrangement of a waveform recording apparatus according to the first embodiment of the present invention.
Figure 4:
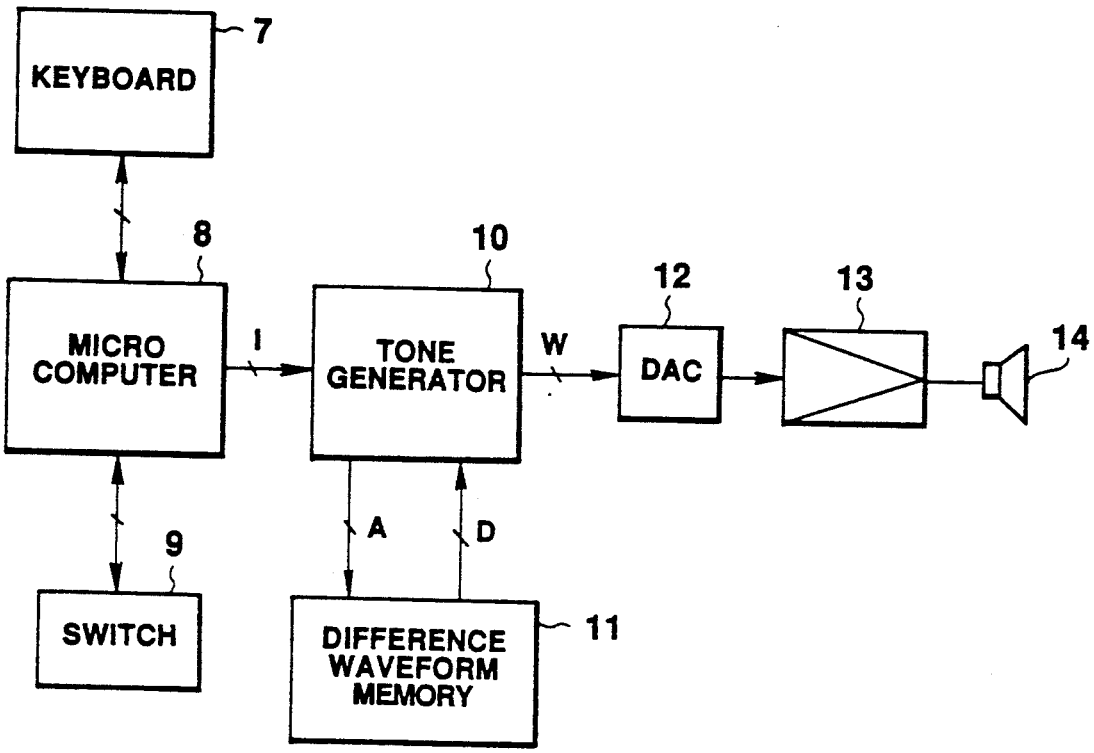
FIG. 4 is a block diagram showing an overall arrangement of an electronic musical instrument incorporating a waveform reproduction apparatus according to the present invention.

FIG. 1 shows an overall arrangement of a waveform recording apparatus. A digital audio tape 1 is a master tape on which tones of acoustic musical instruments and the like are recorded. Recorded information of the digital audio tape 1 is reproduced as a waveform data array by a DAT (digital audio taperecorder) unit 2. The reproduced waveform data array is transferred to a computer 4 through a digital audio interface 3. In the computer 4, processing (to be described later) is performed for the transferred waveform data array to generate a compressed difference data array and various parameters. The compressed difference data array is written in a PROM 6 by a PROM writer 5. The PROM 6 which stores the compressed difference data array serves as a difference waveform memory 11 in a waveform reproduction apparatus (FIG. 4). The various parameters (e.g., an expansion ratio, and an envelope parameter) are used as control data for the waveform reproduction apparatus.

Figure 3:
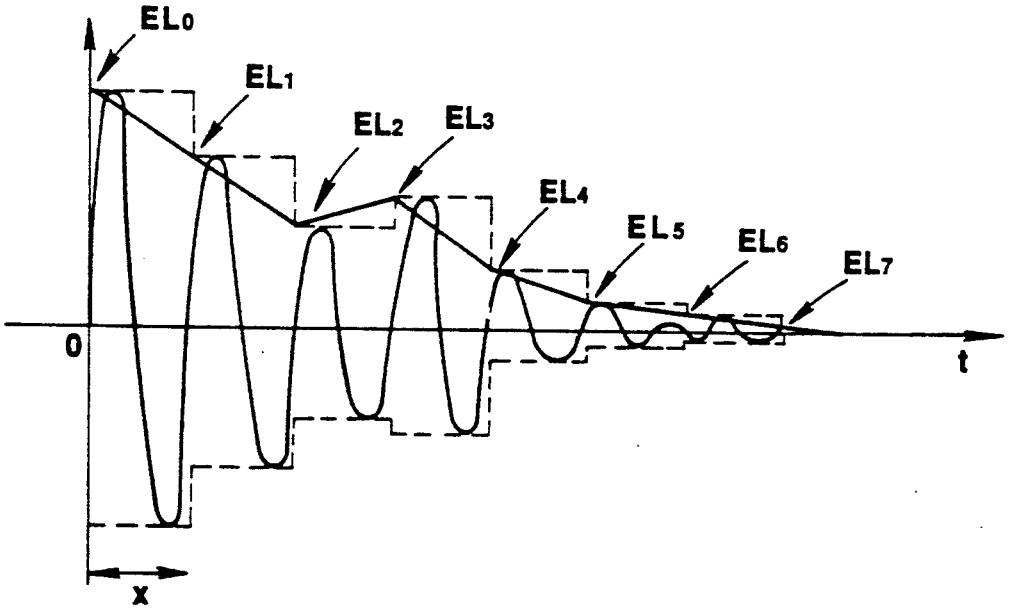
FIG. 3 is a view showing envelope extraction performed in the processing in FIG. 2.
Figure 2:
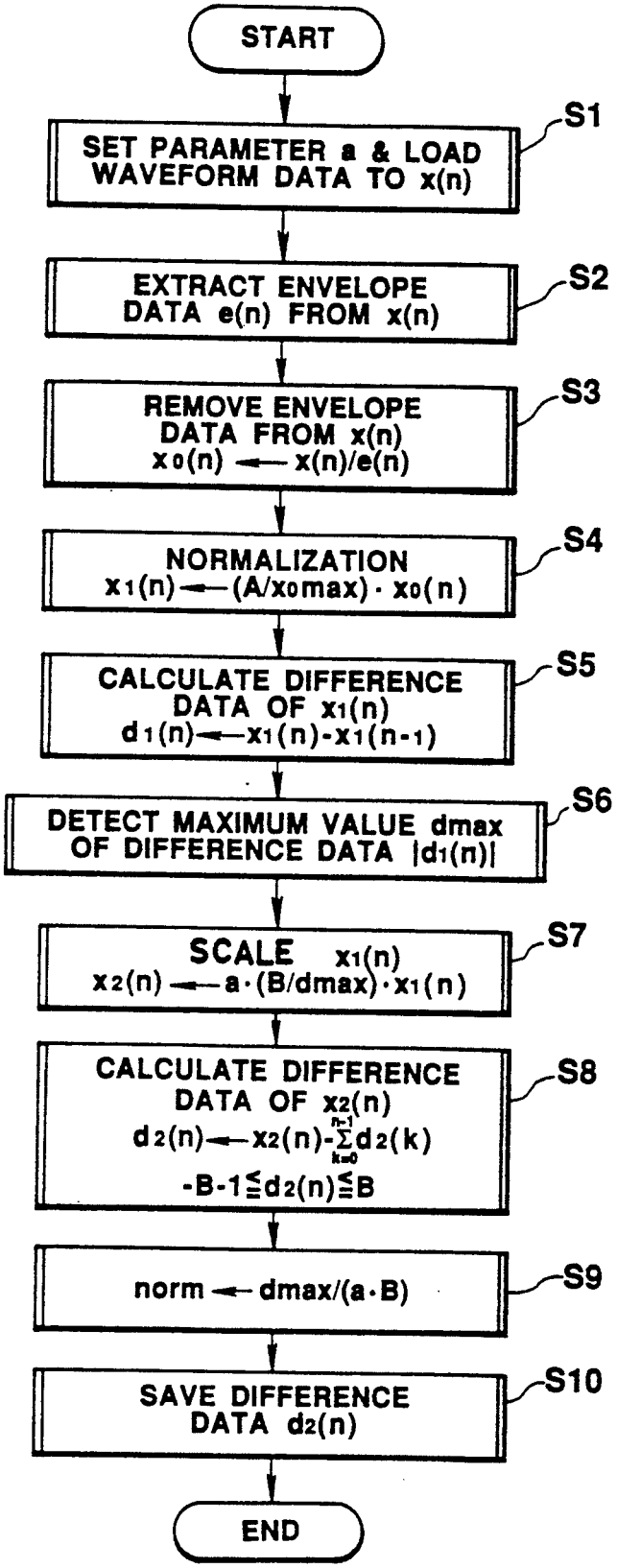
FIG. 2 is a flow chart of compressed difference data array generation processing executed by a computer shown in FIG. 1.

FIG. 2 is a flow chart showing generation of a compressed difference data array in the computer 4. In step S1, a parameter a is set to load a waveform data array to an array $\{x(n)\}$. The parameter a is a coefficient used for generating a scaling ratio (i.e., a scaling scale factor) (to be described later) and satisfies a $a \geqq 1.0$. In step S2, an envelope $\{x(n)\}$ is extracted from a waveform data array $\{x(n)\}$ i.e., $x(0), x(1) \ldots x(n) \ldots$. Several methods are available to extract an envelope (see U.S. Pat. No. 4,958,552 issued on Sep. 25, 1990). For example, information representing the magnitude of waveform data in a predetermined interval of the waveform data array, e.g., the maximum value of an absolute value $|x(n)|$ of the waveform data, a peak-to-peak value of the waveform data, or a power (e.g., a square root of the sum of squares of waveform data) of the waveform data is obtained as an envelope. The predetermined interval is, e.g., a fundamental period of a waveform data array. In FIG. 3, the maximum value of the absolute value $|x(n)|$ is extracted in each predetermined interval X of the waveform data array and is defined as an envelope level $EL_k$ ($k=0, 1, 2 \ldots$). An envelope rate $ER_k$ within the predetermined interval X is obtained by $ER_k=(EL_k-EL_{k-1})/X$. An envelope value e(n) corresponding to each waveform data d(n) is obtained on the basis of these parameters. The extracted envelope $\{e(n)\}$ is used to normalize the waveform data array $\{x(n)\}$ in step S3. That is, each waveform data x(n) is divided by the envelope value e(n). A waveform data array $\{x_0(n)\}$ free from an envelope (normalized) is obtained. By removing the envelope, reproducibility at a portion having a low volume level can be improved.

In step S4, a waveform data array $\{x_1(n)\}$ is normalized by the following operation:

$$x_1(n) \leftarrow (A/x_0max) \cdot x_0(n)$$

where $x_0max$ is the absolute value of maximum waveform data of the waveform data array $\{x_0(n)\}$. For example, when $A=32767.0$ is selected as the value A, the waveform data array $\{x_1(n)\}$ is normalized in the range of +15 bits. That is, the maximum value of the waveform data array $\{x_1(n)\}$ is expressed as a binary number falling within the range of +32767 to −32767. Normalization is performed to obtain equal reproduction levels of various waveforms in the reproduction apparatus when the waveform data array $\{x_1(n)\}$ is reproduced The difference between each adjacent waveform data of the waveform data array $\{x_1(n)\}$ is calculated to a difference data array $\{d_1(n)\}$ in step S5. A maximum value dmax of an absolute value $\{d_1(n)|$ of the difference data array $\{d_1(n)\}$ is extracted in step S6. The number of bits of the difference data $d_1(n)$ is set equal to that of the waveform data $x_1(n)$ or is set enough to accurately express the maximum value of the difference between the $x_1(n)$ and the $x_1(n-1)$ (i.e., this number of bits of the $d_1(n)$ is the one enough to perfectly reproduce the original array $\{x_1(n)\}$ from the array $\{d_1(n)\}$.

In step S7, data scaling is performed using a scaling ratio a·(B/dmax) as follows:

$$x_2(n) \leftarrow a \cdot (B/dmax) \cdot x_1(n)$$

If the number of bits of compressed difference data $d_2(n)$ generated in step S8 is given as 8, then $B=127.0$. If $a=1.0$, then the absolute value of the maximum value of the compressed difference value data calculated from the waveform data $x_2(n)$ becomes 127.0. All the compressed difference data $d_2(n)$ can be expressed as 8-bit data without clipping. That is, B/dmax represents the scaling ratio without clipping. In this case, waveform reproducibility can be improved at a waveform portion having a large variation, but is degraded at a waveform portion having a small variation. The parameter a is a variable for compensating for this point. According to the experience of the present inventors, a reproduced sound having best quality in an auditory sense can be obtained within the range of a=about 1.0 to 2.0. It should be noted that the scaling ratio a·(B/dmax) depends on the magnitude of variation of the waveform data array. It is desirable to provide relatively high numerical precision to the compressed waveform data array $\{x_2(n)\}$. For example, the number of bits of the compressed waveform data $x_2(n)$ may be set equal to that of the waveform data $x_1(n)$ and may be a value for expressing a decimal part by the lower bits of the compressed waveform data $x_2(n)$ (e.g., when the scaling ratio a·(B/max) is ⅛, then upper significant 13 bits of the data $x_1(n)$ are defined as an integer part, and the lower significant three bits are defined as the decimal part as the data $x_2(n)$.

In step S8, the compressed difference data array $\{d_2(n)\}$ is obtained from the compression scaling ratio waveform data array $\{x_2(n)\}$ in accordance with equation (3) as follows:

$$d_2(n) = x_2(n) - \sum_{k=0}^{n-1} d_2(k) \tag{3}$$

where $d_2(n)$ satisfies condition $-B-1<d_2(n)<B$. If the value of the right-hand side of equation (3) is smaller than $-B-1$, the data array is clipped to $d_2(n)=-B-1$. However, when the value of the right-hand side is larger than B, the data array is clipped to $d_2(n)=B$. The data array $d_2(n)$ can be expressed by the number of bits determined by the value B. If B=127.0, then the data array is expressed as 8-bit data. The term $x_2(n)$ in equation (3) represents the nth compressed waveform data in the waveform recording system. The term $$\sum_{k=0}^{n-1} d_2(k)$$

represents the (n−1)th reproduced compressed waveform data to be reproduced by the waveform reproduction system. If a=1 (no clipping), then the following equation can be obtained:

$$\sum_{k=0}^{n-1} d_2(k) = x_2(n-1)$$

Instead of performing the operations in steps S7 and S8 the compressed difference data array $\{(d_2(n)\}$ may be directly obtained from the difference data array $\{d_1(n)\}$ by using the scaling ratio (a·B/dmax).

$$\begin{aligned} d_2(n) &= a \cdot B/d\max\left\{\sum_{k=0}^{n} d_1(k) - (d\max/a \cdot B) \cdot \sum_{k=0}^{n-1} d_2(k)\right\} \\ &= a \cdot B/d\max(d_1(n) + e(n-1)) \end{aligned}$$

$$\begin{aligned} e(n-1) &= \sum_{k=0}^{n-1} d_1(k) - (d\max/a \cdot B) \cdot \sum_{k=0}^{n-1} d_2(k) \\ &= e(n-2) + \{d_1(n-1) - (d\max/a \cdot B) \cdot d_2(n-1)\} \end{aligned}$$

The array $d_2(n)$ is clipped to $d_2(n)=-B-1$ when the value of the right-hand side of equation (3) is smaller than $-B-1$, but is clipped to $d_2(n)=B$ when the value of the right-hand side is larger than B.

If a=1 (no clipping), the term $$\sum_{k=0}^{n-1} d_2(k)$$

in equation (3) becomes equal to $x_2(n-1)$. In this case, instead of performing the operations in steps S7 and S8, the compressed difference data array $\{d_2(n)\}$ can be obtained from $d_2(n)=a\cdot(B/dmax)\cdot d_1(n)$.

A reciprocal number dmax/a·B of the scaling ratio is stored as a scale factor (expansion ratio) norm in the waveform data reproduction system in step S9. As will be described later, the value of the norm is multiplied with waveform data obtained by accumulating the compressed difference data in the reproduction system. The waveform data can be normalized within the predetermined numeric range (e.g., −32767 to 32767) regardless of the types of waveform data. The value of the norm falls within the range of 5 to 15 for piano waveform data sampled at a sampling frequency of 32 kHz.

In the last step S10, the calculated compressed difference data array $\{d_2(n)\}$ is saved in a file.

By the above processing, the compressed difference data array $\{d_2(n)\}$, the scale factor (expansion ratio) norm, and the envelope data array $\{e(n)\}$ are obtained.

The above processing (FIG. 2) is performed for several values of the parameter a, and reproduction is performed in an auditory experiment. Data (i.e., a scale factor, a compressed difference data array, and an envelope data array) having best reproducibility in the above auditory experiment are preserved, and their compressed difference data array is written in the PROM 6 to prepare the difference waveform memory 11.

The waveform reproduction apparatus will be described below. FIG. 4 is a block diagram showing an electronic musical instrument incorporating the waveform reproduction apparatus. A microcomputer 8 transfers to a tone generator 10 data corresponding to a tone color selected upon scanning of a switch 9 by a known technique. A keyboard 7 is scanned, and information of a depressed key is transferred to the tone generator 10. The tone generator 10 performs an arithmetic operation of compressed difference data from the difference waveform memory 11 to generate (reproduce) a musical tone waveform w in accordance with a waveform reproduction method of the present invention. The musical tone is produced through a DAC (digital-/analog converter) 12, an amplifier 13, and a loudspeaker 14.

Figure 5:
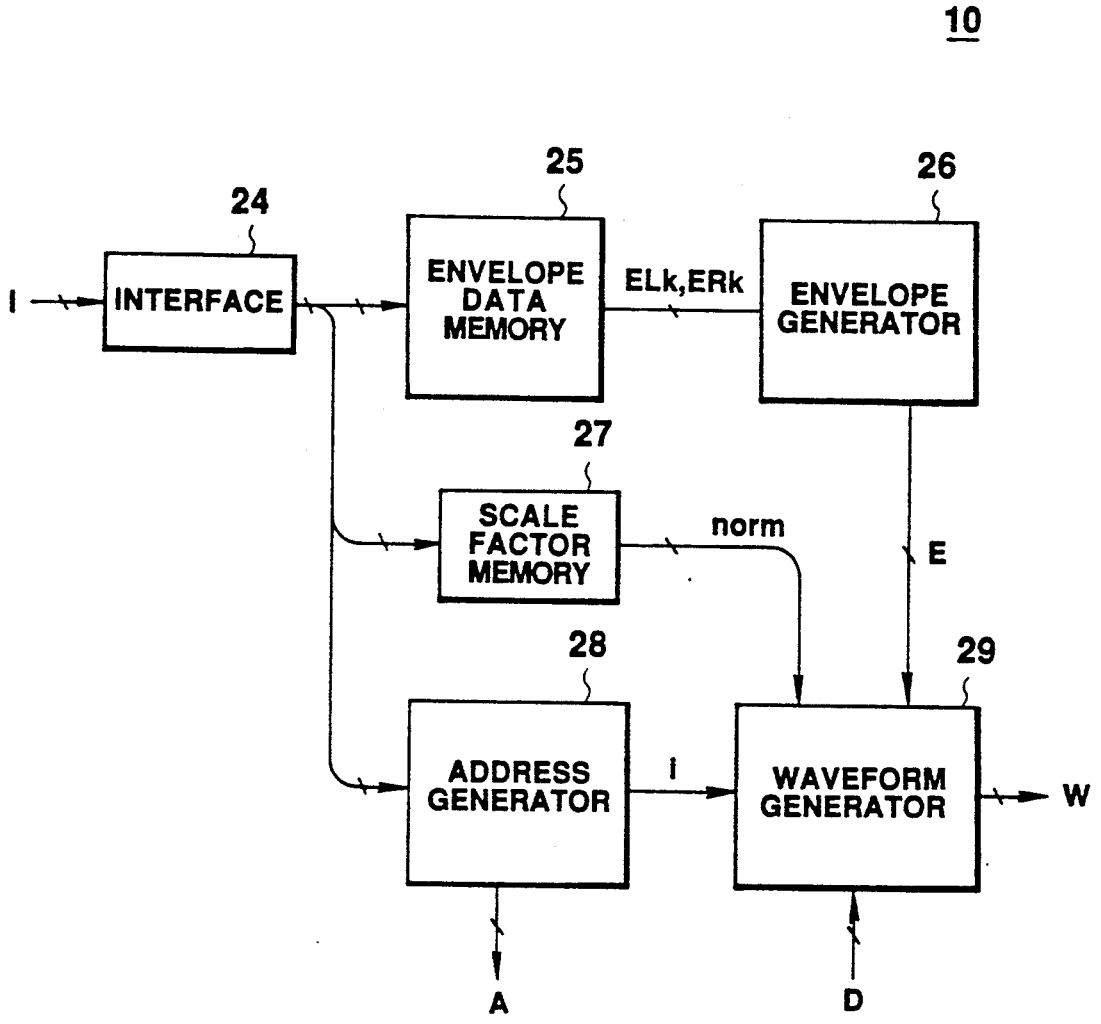
FIG. 5 is a block diagram showing an arrangement of a tone generator in FIG. 4.

FIG. 5 shows an arrangement of the tone generator 10. An interface 24 is arranged to write data from the microcomputer 8 (FIG. 4) in the tone generator 10. Envelope level data $EL_k$ and envelope rate data $ER_k$ are stored in an envelope data memory 25. The scale factor (expansion ratio) norm is stored in a scale factor memory 27. Frequency data corresponding to a pitch is stored in an address generator 28. An envelope generator 26 receives the envelope level data $EL_k$ and the envelope rate data $ER_k$ from the envelope data memory 25 and generates an envelope E. The address generator 28 generates an address A which changes at a rate corresponding to the frequency data, and sends an increment signal i to a waveform generator 29 every time the address A is updated. The waveform generator 29 serves as a reproducing means for reproducing the waveform in accordance with the waveform reproduction method of the present invention. In response to the increment signal i from the address generator 28, the waveform generator 29 generates a musical tone waveform W by using the compressed difference data D from the difference waveform memory 11, the scale factor norm from the scale factor memory 27, and the envelope E from the envelope generator 26.

Figure 6:
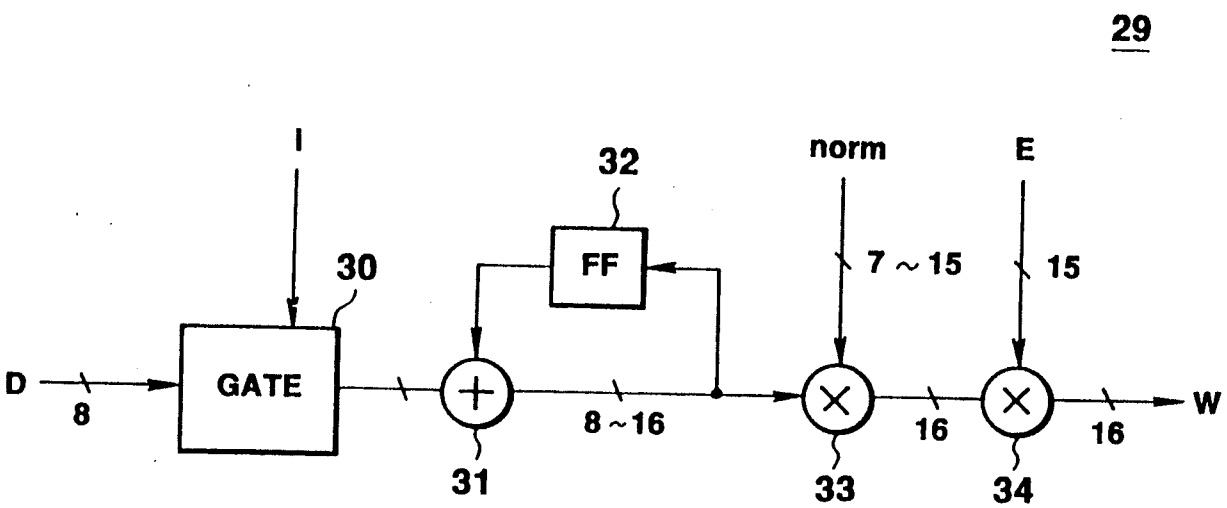
FIG. 6 is a block diagram of a waveform generator in FIG. 5.

The function of the waveform generator 29 is shown in FIG. 6. A gate 30 gates and sends the compressed difference data D (e.g., 8-bit data) to an accumulator (accumulating means) constituted by an adder 31 and an FF (flip-flop) 32 when the increment signal i is received, i.e., when the address A is updated and the compressed difference data from the difference waveform memory 11 is updated. The accumulator 31, 32 accumulates the compressed difference data D to generate reproduced compressed waveform data (accumulation output) of 8 to 16 bits. This accumulation output is multiplied by a multiplier 33 with the scale factor norm output from the scale factor memory 27. The accumulation results having different magnitudes depending on the types of waveforms are therefore normalized into reproduced waveform data (reproduced normalized waveform data) each having a 16-bit range. A multiplier 34 multiplies the reproduced normalized waveform data with the envelope E and outputs the final waveform data W. Therefore, the output W from the waveform generator 29 represents an envelope-added musical tone waveform having a maximum range of 16 bits.

In order to generate reproduced normalized waveform data, the compressed difference data D from the gate 30 may be expanded (multiplied) with the scale factor (expansion ratio) norm, and the resulting data may then be accumulated.

The envelope level and the rate data set in the envelope data memory 25 are determined on the basis of the envelope extracted in S2 (FIG. 2) of the waveform recording apparatus. Since the number of segments (e.g., attack segments) of the envelope generated by the envelope generator 26 is generally limited, an extracted envelope is approximated with an envelope (i.e., an envelope level and a rate in units of segments) constituted by a limited number of segments. A technique as disclosed in U.S. Pat. No. 4,958,552 issued on Sep. 25, 1990 can be used for this envelope approximation. Basically, an appropriate segment count is set, and an error of an extracted envelope from a polygonal envelope constituted by the appropriate number of segments (e.g., characteristic switching points, i.e., deflections are selected as points on the extracted envelope) is evaluated. A polygonal envelope for minimizing the error is selected to perform optimal approximation. This result (i.e., envelope level data and rate data of each segment constituting the selected polygonal envelope) is stored as reference envelope parameters in the microcomputer 8 in the electronic musical instrument. In operation, the microcomputer 8 changes the reference envelope parameters depending on key touches or the like and writes the updated data in the envelope data memory 25.

If desired, an envelope may be generated independently of the extracted envelope.

In the arrangement of FIG. 6, two multiplications (i.e., the norm multiplication and the envelope E multiplication) are required every time a sample of the musical tone waveform W is generated. For example, when the waveform generator 29 having the function shown in FIG. 6 is to be realized by a time-division multiplexing (TDM) arrangement, one multiplier hardware multiplies the norm and the accumulation output in a given time slot within the sampling period, and this product is multiplied with the envelope in another time slot. If a polyphonic count of the waveform generator 29 is defined as N, the waveform generator 29 must perform a total of 2N multiplications every sampling period. The reduction in multiplication count is effective to reduce the processing data volume of the waveform generator 29.

Figure 7:
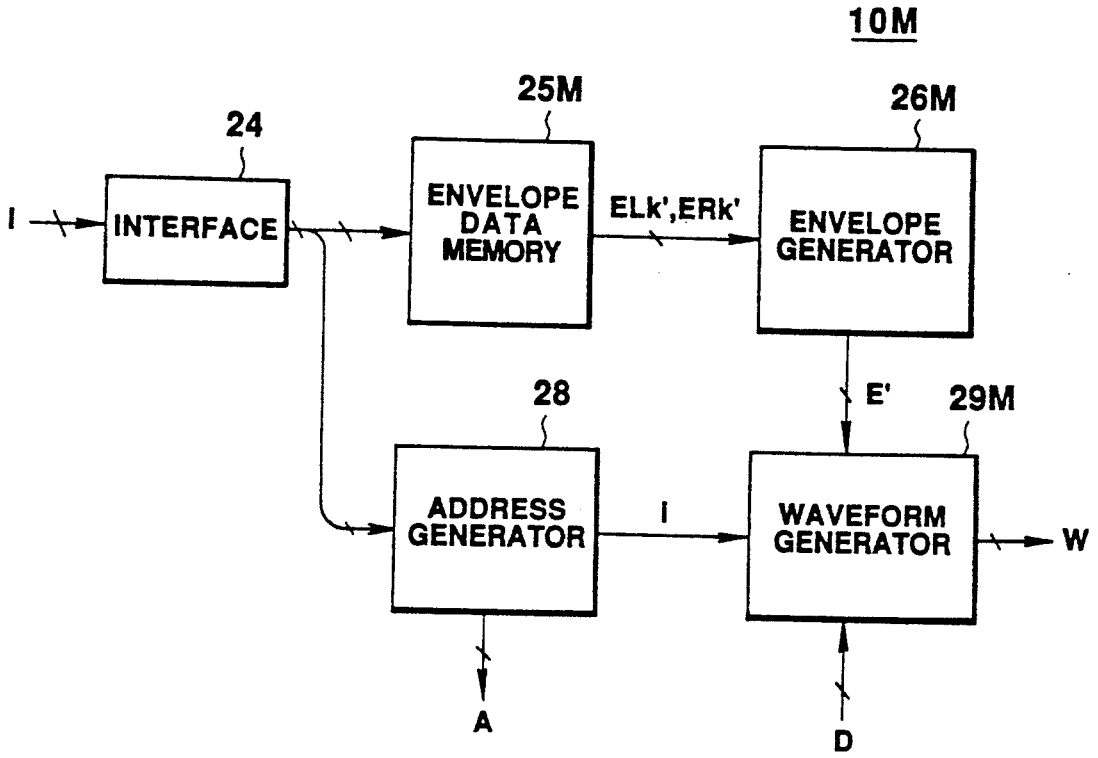
FIG. 7 is a block diagram showing another arrangement of the tone generator shown in FIG. 4.
Figure 8:
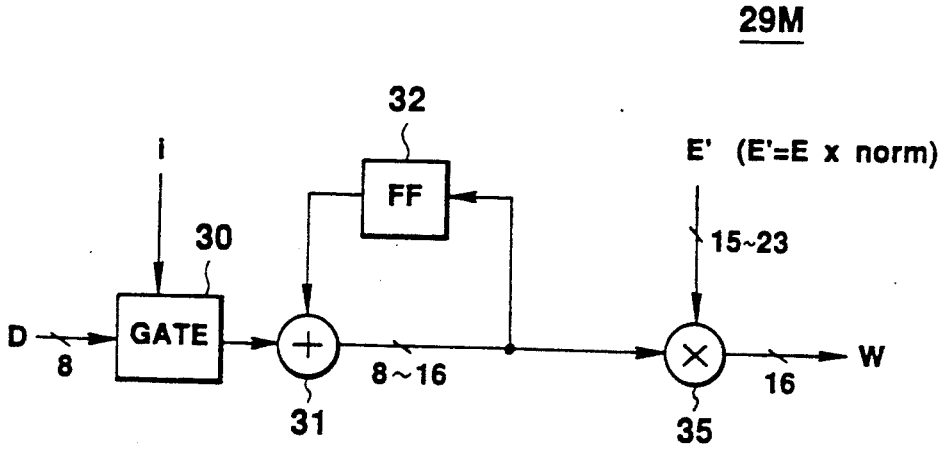
FIG. 8 is a block diagram showing an arrangement of the waveform generator of FIG. 7 so as to reduce the number of multiplications in waveform reproduction.

An arrangement of a tone generator 10M having a smaller number of multiplications and a corresponding arrangement of a waveform generator 29M are shown in FIGS. 7 and 8, respectively. In this system, the tone generator 10M does not require the scale factor memory 27. A microcomputer 8 writes envelope level data $EL_k'$ reflecting the scale factor norm and envelope rate data $ER_k'$ reflecting the scale factor norm in a data memory 25M.

An envelope generator 26M generates envelope data E' expanded with the scale factor (expansion ratio) norm. That is, this envelope E' corresponds to a product of the envelope E shown in FIGS. 5 and 6 and the scale factor norm. This envelope E' is multiplied with an accumulation output of the accumulator (31 and 32) by a multiplier 35 in the waveform generator 29M in FIG. 8, thereby immediately obtaining the final musical tone waveform W.

with the above arrangement, the waveform generator 29M needs to perform only one multiplication to generate one musical tone waveform sample, thereby reducing the required number of multiplications.

The first embodiment has been described above. Various changes and modifications of the first embodiment may be made within the spirit and scope of the invention.

For example, in the above embodiment, in order to improve reproducibility at a low volume level, the envelope is removed from the waveform in the recording system. In the reproduction system, the envelope is added to the waveform. However, if desired, these processing operations can be omitted. In addition, an envelope may not be removed by the recording system and may be added by the reproduction system.

A waveform recording function may be incorporated in a sampling musical instrument or the like in accordance with the waveform recording method of the present invention. In this case, the compressed difference waveform data array is written in a read/write memory such as a RAM.

The expansion ratio norm need not be a reciprocal number of the compression ratio, but may be a value close to the reciprocal number.

SECOND EMBODIMENT

This embodiment is characterized by generating a non-linear compressed difference data array, unlike in the first embodiment wherein a linear compressed difference data array is generated. More specifically, in the second embodiment, a compressed non-linear difference data array is calculated by a computer 4 in FIG. 1. The compressed non-linear difference data array is written in a PROM 6 by a PROM writer 5. The PROM 6 which stores the compressed non-linear difference data array serves as a difference waveform memory 11 in a waveform reproduction apparatus (FIG. 4).

Figure 9:
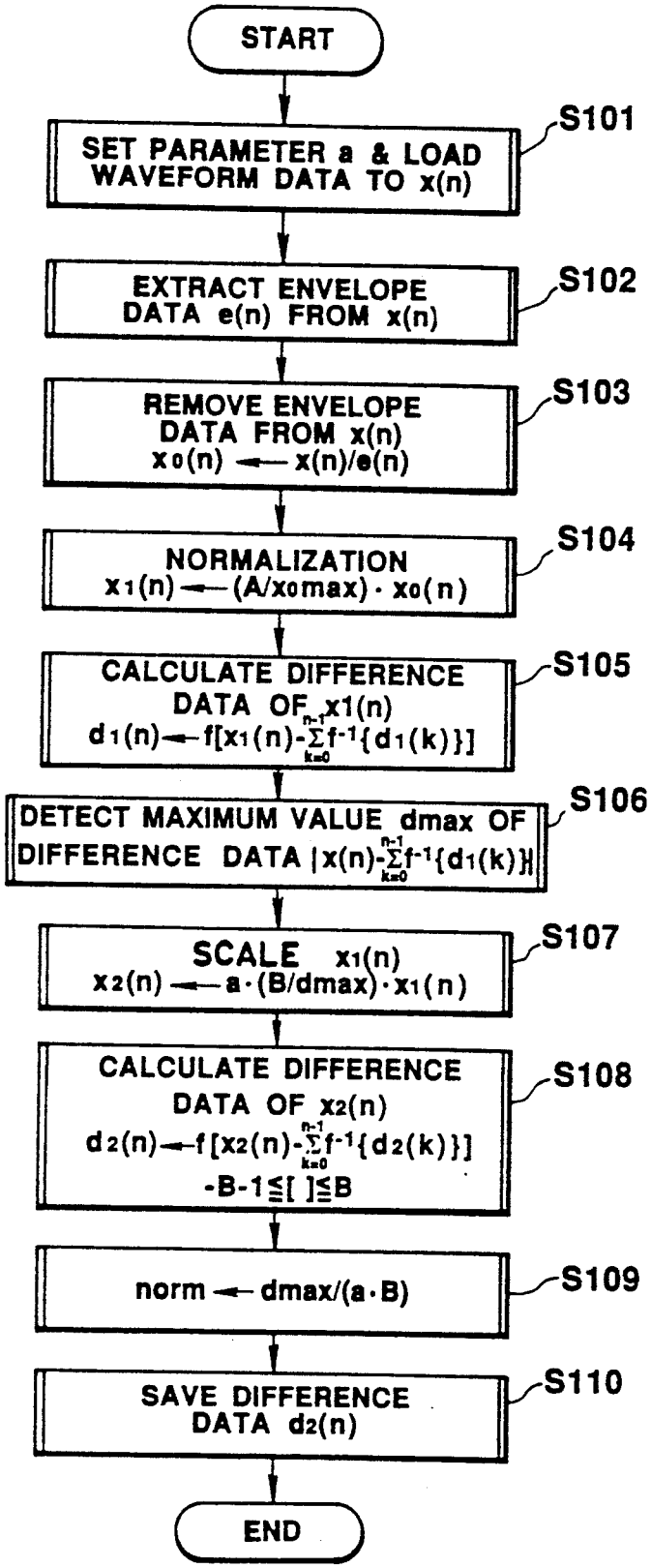
FIG. 9 is a flow chart of compressed non-linear difference data array generation executed by the computer of FIG. 1 according to the second embodiment of the present invention.

FIG. 9 is a flow chart of generation of a compressed non-linear difference data array in the computer 4. This flow chart is similar to that (FIG. 2) of the first embodiment, and the same parts as in the first embodiment are briefly described below. In step S101, a parameter a is set, and a waveform data array is loaded to an array {x(n)}. The parameter a is a coefficient used for generating a compression scaling ratio (i.e., a scaling scale factor) (to be described later). In step S102, an envelope {e(n)} is extracted from the waveform data array {x(n)}, i.e., x(0), x(1), . . . , x(n), . . . . Several envelope extraction methods may be used (e.g., the technique disclosed in U.S. Pat. No. 4,958,552 described above). The extracted envelope {e(n)} is used to normalize a waveform data array (x(n)) in step S103. More specifically, each waveform data x(n) is divided by an envelope value e(n) to obtain a waveform data array $\{x_0(n)\}$ from which an envelope is removed (normalized).

In step S104, a waveform data array $\{x_1(n)\}$ is normalized in accordance with the following operation:

$$x_1(n) \leftarrow (A/x_0max) \cdot x_0(n)$$

In step S105 (this step is provided for the sake of descriptive convenience and can be omitted in practice), a non-linear difference data array $\{d_1(n)\}$ is obtained by the following operation:

$$d_1(n) \leftarrow f\left[ x_1(n) - \sum_{k=0}^{n-1} f^{-1}\{d_1(k)\} \right] \tag{4}$$

where f(x) is the non-linear function, i.e., a logarithmic function represented as follows:

$$f(x) = \text{sign}(x) \cdot Ymax \cdot \frac{\log\left[1 + \mu \frac{|x|}{Xmax}\right]}{\log[1 + \mu]} \tag{5}$$

where Xmax is the maximum value of an input signal x, Ymax is the maximum value of an output signal y (=f(n)), and M is the conversion characteristic parameter. If Xmax=32767.0 and Ymax=127.0, then a ±15-bit input signal x is converted into a ±7-bit out-put signal y by equation (5).

In the conventional non-linear difference scheme, the non-linear difference data array $\{d_1(n)\}$ obtained by equation (4) is recorded as the final waveform information. The input signal x defined in equation (5) represents a linear difference of the waveform data array $\{x_1(n)\}$, as indicated by the content of [], i.e., $$x_1(n) - \sum_{k=0}^{n-1} f^{-1}\{d_1(k)\}.$$

The maximum value of this linear difference depends on the type of waveform data. The maximum value varies depending on the types of waveform data arrays (therefore the types of original tones). Xmax=32767.0 described with reference to equation (4) is not generally established. The maximum value Xmax can take any value smaller than 32767.0. If the non-linear function f(x) shown in equation (5) is given as a 16/8-bit logarithmic conversion function, the entire conversion range (i.e., the full conversion range) on the input side is −32767.0 to +32767.0, and the full conversion range on the output side is −127.0 to +127.0. In the conventional non-linear difference scheme, if the maximum value of the linear difference of the waveform data array $\{x_1(n)\}$ falls within the range of ±4,000, only a portion of −4,000 to 4,000 of the input full range of −32767.0 to +32767.0 is used. In this manner, only part of the non-linear conversion range is used in the conventional non-linear difference scheme, and satisfactory reproducibility cannot be obtained. In addition, a range in which non-linear conversion is performed varies depending on the types of waveforms in the conventional non-linear difference scheme, thereby varying the reproducibility.

Figure 10:
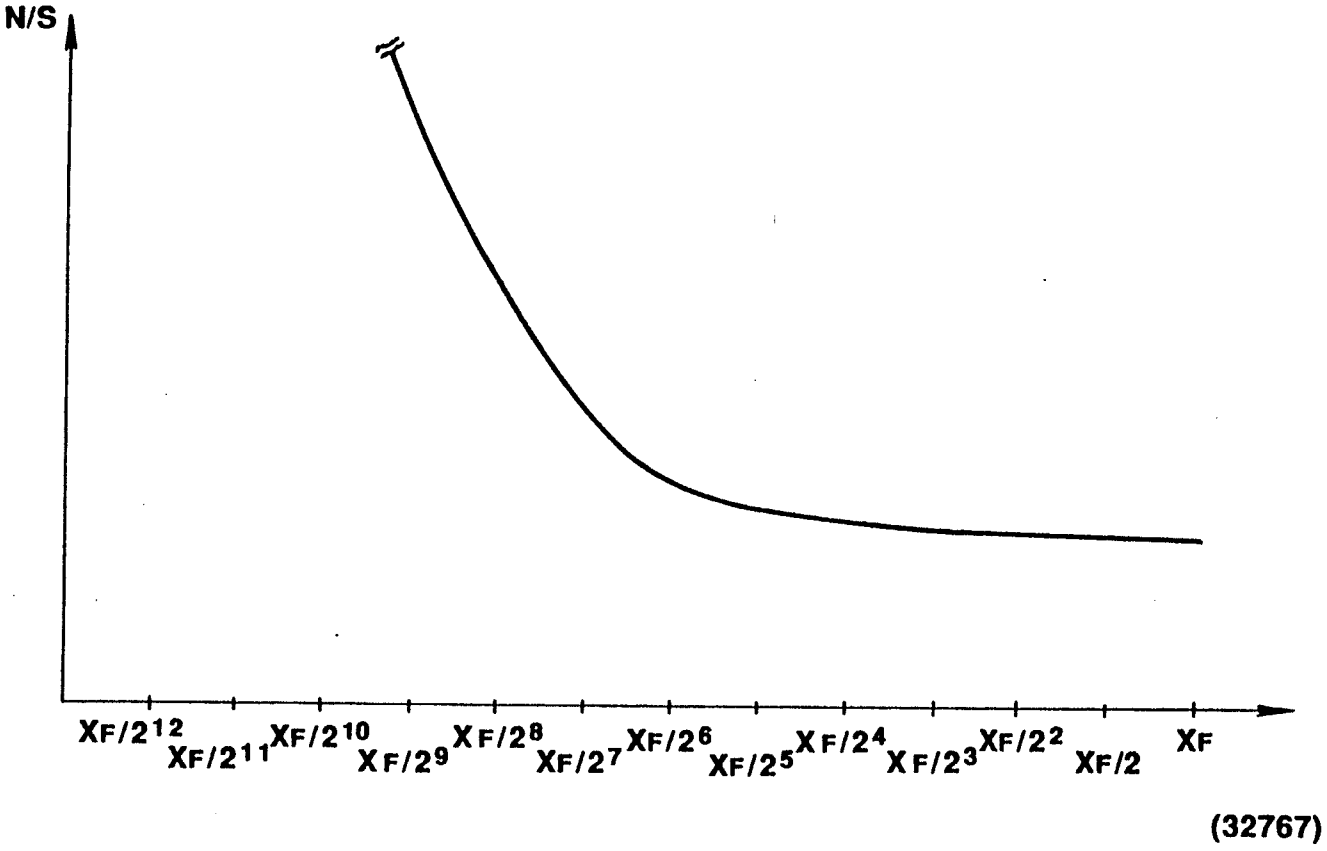
FIG. 10 is a graph showing S/N characteristics associated with a specific non-linear function so as to explain an S/N ratio increase effect by compression scaling processing within a linear space in the flow chart in FIG. 9.

FIG. 10 shows N/S ratios when the logarithmic function of equation (5) is used as the non-linear function f(x). When a 16-bit input signal (i.e., a difference in the waveform data array) is processed with the 16/8-bit logarithmic function f( ) and is further processed by an 8/16-bit exponential function $f^{-1}$( ) as a reverse function of the 16/8-bit logarithmic function f( ), the value of the 16-bit input signal to the logarithmic function f( ) does not generally coincide with that of the 16-bit output signal from the exponential function $f^{-1}$( ). A value S of an input signal having the range of S−e1 to S+e2 is converted into an output signal having the value S. For the sake of descriptive simplicity, assume that (e1+e2)/2=N (noise), and that the N/S is defined as a noise-to-signal ratio (i.e., a noise-to-signal ratio upon processing with the non-linear function and its reverse function). FIG. 10 shows N/S ratios (i.e., reciprocal values of the S/N ratios) with respect to the magnitudes of input signals (these may be regarded as output signals) for $\mu$=200. As can be understood from FIG. 10, when a signal is processed with the logarithmic function f(x) and its reverse function, its N/S ratio is decreased (i.e., the S/N ratio is increased) with an increase in signal value. If the maximum value of the linear difference data array of the waveform data array is given as 4,000, as described above, this value corresponds to about ⅛ of the input full range value $X_F$(=32767), i.e., $X_F/2^3$ in FIG. 10. This linear difference data array is constituted by data (elements) having various values within the partial range of −4,000 to 4,000. When the elements of the linear difference data arrays are to be changed to larger values in accordance with a scaling ratio (to be described later) of the present invention e.g., when the range used is changed to the full range, all the S/N ratios are higher than those prior to the change. In particular, when the characteristics in FIG. 10 are used, the S/N ratios are greatly increased for the elements having small values (i.e., waveform data portions having small variations).

Even in other non-linear functions, where there are characteristics (i.e., characteristics for minimizing all the S/N ratios in full-range conversion) for reducing the N/S ratios (i.e., ratios of noise components to signal components) as a result of a combination of the non-linear and reverse functions with an increase in signal level, all the S/N ratios can be increased by the above method.

In order to realize this method, in step S106 in FIG. 9, a maximum value dmax of an absolute value $$\left| x_1(n) - \sum_{k=0}^{n-1} f^{-1}\{d_1(k)\} \right|$$

of the linear difference is obtained from the linear difference data array of the waveform data array (note that x1(n−1) and can be used in place of $$\sum_{k=0}^{n-1} f-1\{d1(k)\}\Big).$$

A compression scaling ratio a·(B/dmax) is calculated from the maximum value dmax of this linear difference, the full-range input value B ( e. g., 32767.0) , and the parameter a. In step S107, the waveform data array $\{x_1(n)\}$ is compressed using this compression scaling ratio a·(B/dmax) to form a compressed waveform data array $\{x_2(n)\}$. If a=1, then the maximum value dmax of the linear difference array of the waveform data array $\{x_1(n)\}$ becomes the full-range input value B in the linear difference array of the compressed waveform data array $\{x_2(n)\}$. The range of the linear difference array (i.e., the input for non-linear conversion logarithmic function f(x)) of the compressed waveform data array $\{x_2(n)\}$ becomes the full range (e.g., ±15 bits). In practice, the values of the parameter a are caused to vary with reference to a=1, and the resulting musical tones are reproduced to determine a value having best reproducibility. As will be described later, if a>1, then some difference data (i.e., large difference data) are clipped to the full-range value. In this case, small difference data have higher S/N ratios However if a ≦1 then no clipping occurs.

In step S108, by using the logarithmic function f(x), the following operation is performed:

$$d2(n) \leftarrow \left[ x2(n) - \sum_{k=0}^{n-1} f^{-1}\{d2(k)\} \right] \quad (6)$$

to form the compressed non-linear difference data array $\{d_2(n)\}$ having a smaller number of bits (e.g., 8 bits) than M bits from the M-bit (e.g., 16 bits) compressed waveform data array $\{x_2(n)\}$. In this case, $x_2(n)$ is the nth compressed waveform data in the recording system, and $$\sum_{k=0}^{n-1} f^{-1}\{d_2(k)\}$$

represents the (n−1)th compressed waveform data reproduced in the reproduction system. When the value of $$x_2(n) - \sum_{k=0}^{n-1} f^{-1}\{d2(k)\}$$

represented in [ ] in the calculation of equation (6) is larger than B the value is clipped to the positive full-range input value B. However, when the value is smaller than −B−1, then it is clipped to the negative full-range input value −B−1. This clipping occurs for a>1. However, if a≦1, then no clipping occurs.

In step S109, a reciprocal value dmax/a·B of the compression ratio is stored as a scale factor (expansion ratio) norm in the waveform data reproduction system.

In the last step S110, the calculated compressed difference data array $\{d_2(n)\}$ is saved in a file.

By the above processing, the compressed non-linear difference data array $\{d_2(n)\}$ the scale factor (expansion ratio) norm, and the envelope data array {e(n)} can be obtained.

The waveform recording apparatus performs the above processing (FIG. 9) for several values of the parameter a. Reproduction is performed, and data (the scale factor, the compressed non-linear difference data array, and the envelope data array) having best reproducibility in the auditory test are stored. The compressed non-linear difference data array is written in the PROM 6 to prepare the difference waveform memory 11.

The waveform reproduction apparatus will be described below. The block diagram of the electronic musical instrument incorporating the waveform reproduction apparatus in FIG. 4 described with reference to the first embodiment can be employed in the second embodiment. A tone generator 10 performs arithmetic operations of the compressed non-linear difference data of the difference waveform memory 11 in accordance with the waveform reproduction method of the present invention to generate (reproduce) a musical tone waveform W. A musical tone represented by the musical tone waveform W is produced through a DAC 12, an amplifier 13, and a loudspeaker 14.

The arrangement of the tone generator 10 (FIG. 5) described with reference to the first embodiment can also be employed in the second embodiment. A waveform generator 29 is a means for reproducing a waveform in accordance with the waveform reproduction method of the present invention. In response to an increment signal i from an address generator 28, the waveform generator 29 generates the musical tone waveform W using the compressed non-linear difference data D from the difference waveform memory 11, the scale factor norm from a scale factor memory 27, and the envelope data E from an envelope generator 26.

Figure 11:
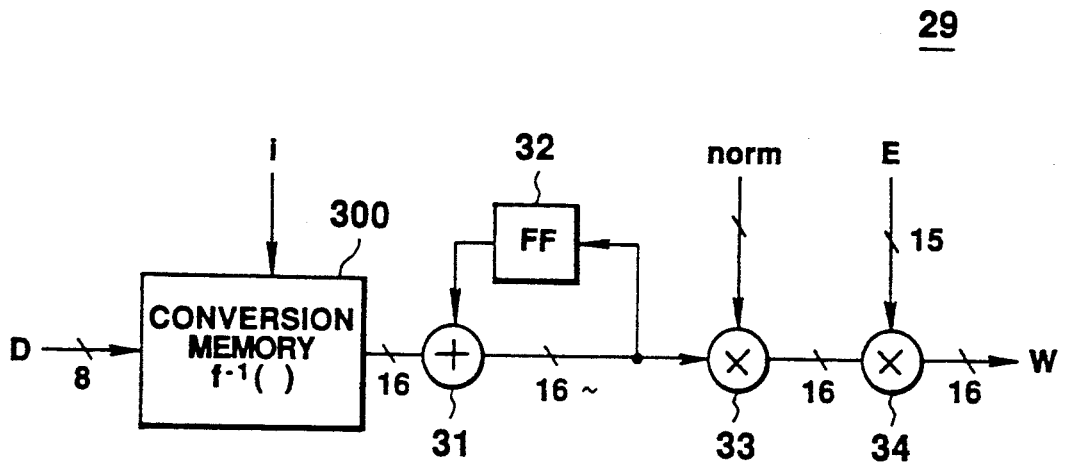
FIG. 11 is a block diagram showing an arrangement as the waveform generator of FIG. 5 so as to perform expansion processing within a linear space.

FIG. 11 shows the function of the waveform generator 29. A conversion memory 300 stores a reverse function $f^{-1}$( ) of a non-linear function f( ) used in waveform recording by the waveform recording apparatus (FIG. 1). For the sake of descriptive simplicity, the non-linear conversion process S108 in FIG. 9 is assumed as processing for converting 16-bit compressed linear difference data into 8-bit compressed non-linear difference data by the logarithmic function represented by equation (5), In this case, the conversion memory 300 serves as a means for reverse-converting the 8-bit compressed non-linear difference data from the difference waveform memory 11 into the 16-bit compressed linear difference data in accordance with the reverse function $f^{-1}$( ) stored in the conversion memory 300, The conversion memory 300 includes a gate operated in response to the signal i. Only if the signal i is set at "1", i.e., only if the address A is updated, the conversion memory 300 outputs 16-bit compressed linear difference data corresponding to (new) 8-bit compressed non-linear difference data read out from the difference waveform memory 11. The 16-bit compressed linear difference data from the conversion memory 300 is input to an accumulator (accumulating means) constituted by an adder 31 and an FF 32. The accumulator 31, 32 accumulates compressed linear difference data having a range normalized to ±15 bits and reproduces compressed waveform data (accumulation output). This accumulation output is multiplied with the scale factor norm from the scale factor memory 27 by a multiplier 33, so that accumulation outputs having different magnitudes depending on the types of waveforms are normalized into 16-bit reproduced waveform data. A multiplier 34 is arranged to multiply the normalized reproduced waveform data with the envelope data E and output the final waveform data w. Therefore, the output W from the waveform generator 29 becomes an envelope-added musical tone waveform having a maximum range of 16 bits.

In the arrangement of FIG. 11, the waveform generator 29 must perform two multiplications (i.e., the norm multiplication and the envelope multiplication) every time the musical tone waveform W is sampled. When the waveform generator 29 having the function shown in FIG. 11 is to be realized by a time-division multiplexing (TDM) arrangement, one multiplier hardware multiplies the norm and the accumulation output in a given time slot within the sampling period, and this product is multiplied with the envelope data E in another time slot. If a polyphonic count of the waveform generator 29 is defined as N, the waveform generator 29 must perform a total of 2N multiplications every sampling period. The reduction in multiplication count is effective to reduce the processing data volume of the waveform generator 29.

An arrangement of a tone generator 10M having a smaller number of multiplications and a corresponding arrangement of a waveform generator 29M are shown in FIGS. 7 (the same as in the first embodiment) and 12, respectively. In this system, the tone generator 10M does not require the scale factor memory 27. A microcomputer 8 writes envelope level data $EL_k'$ reflecting the scale factor norm and envelope rate data $ER_k'$ reflecting the scale factor norm in a data memory 25M.

Figure 12:
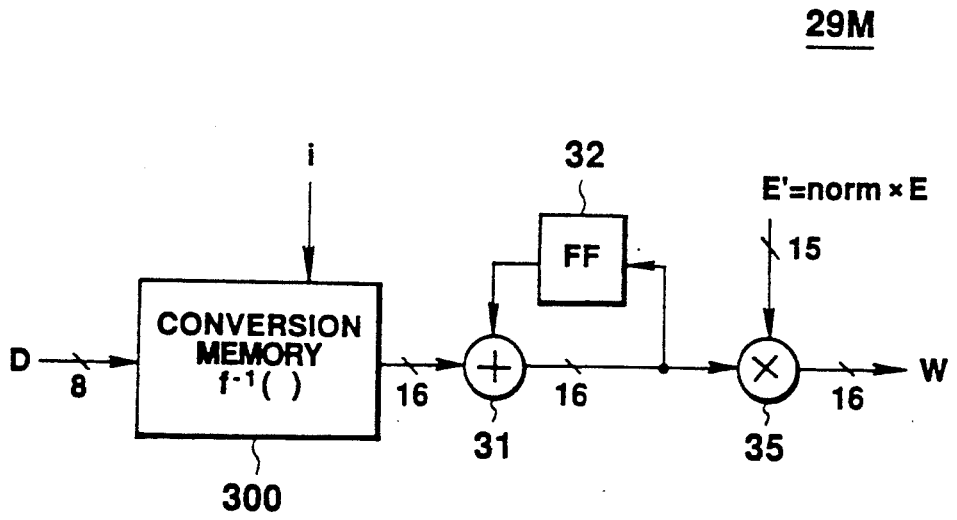
FIG. 12 is a block diagram showing an arrangement for performing expansion processing and envelope addition processing by one multiplication in the waveform generator of FIG. 7.

An envelope generator 26M generates an envelope E' expanded with the scale factor (expansion ratio) norm. That is, this envelope data E' corresponds to a product of the envelope E shown in FIGS. 5 and 11 and the scale factor norm. This envelope data E' is multiplied with an accumulation output of the accumulator (31 and 32) by a multiplier 35 in the waveform generator 29M in FIG. 12, thereby immediately obtaining the final musical tone waveform w.

with the above arrangement, the waveform generator 29M needs to perform only one multiplication to generate one musical tone waveform sample, thereby reducing the required number of multiplications.

The scaling processing and the expansion processing described with reference to FIGS. 9 and 11 are performed within the linear space. That is, in the recording system (FIG. 9), the scaling process S107 is performed for the waveform data array prior to non-linear conversion (S108). In the reproduction system (FIG. 11), the expansion processing is performed for the compressed waveform data array by the multiplier 33 after the reverse conversion (second non-linear conversion) of the non-linear conversion S108 in the recording system is performed by the conversion memory 300.

The scaling processing and the expansion processing may be performed within a non-linear space in place of the above processing operations. That is, in the recording system, scaling processing is performed after non-linear conversion is performed. In the reproduction system, expansion processing is performed after reverse conversion is performed.

Figure 13:
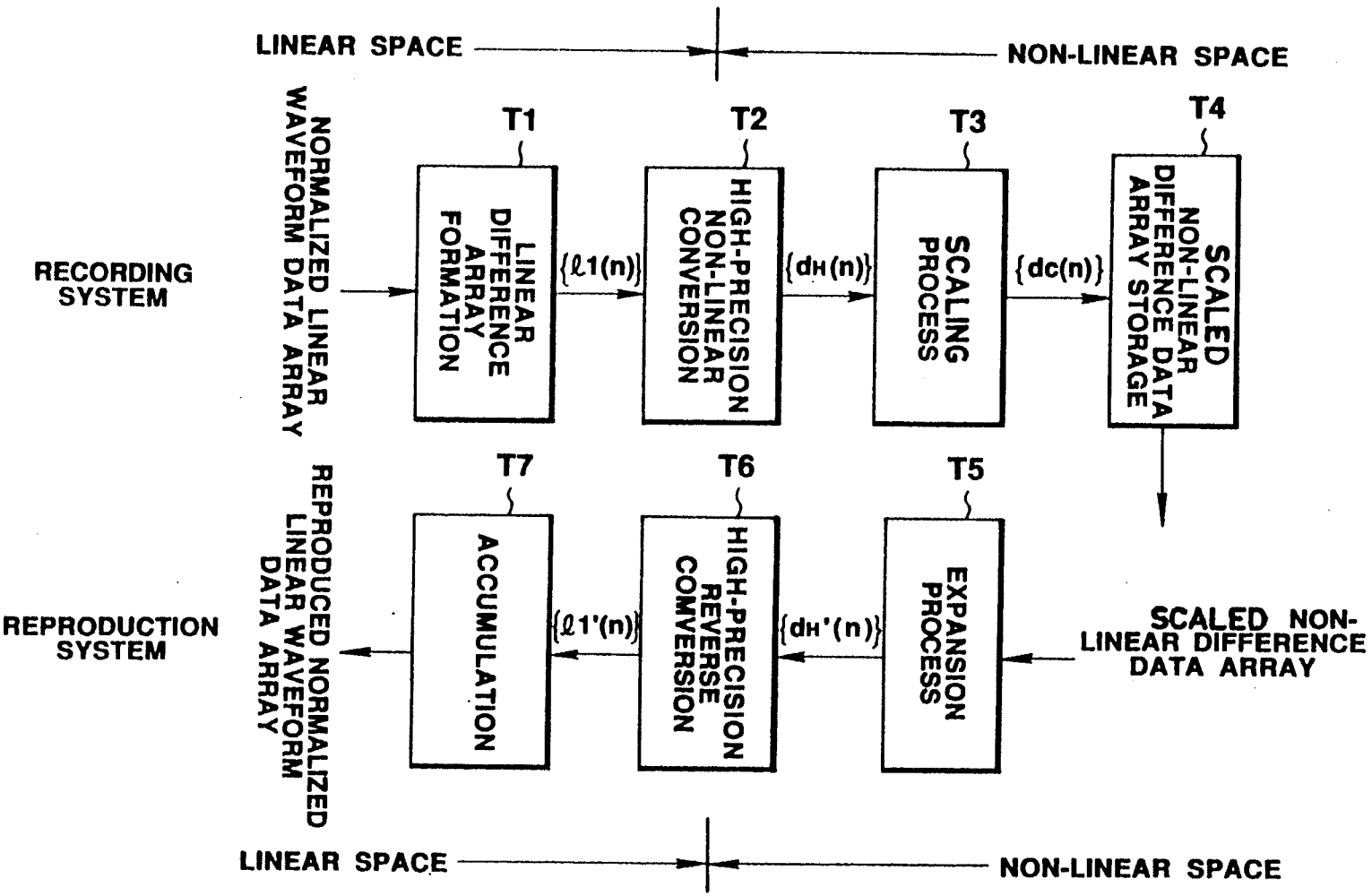
FIG. 13 is a flow chart showing a waveform recording/reproduction method of the present invention which performs compression scaling processing and expansion processing within a non-linear space.

The main part of a waveform recording/reproducing method of performing scaling processing and expansion processing within the non-linear space is shown in FIG. 13. In step T1 of the recording system, a linear difference array $\{l_1(n)\}$ is formed from a linear waveform data array (corresponding to the data array $\{X_1(n)\}$ obtained in the normalization process in step S104 of FIG. 9) normalized in the range of, e.g., ±15 bits. This can be obtained by the following operation:

$$l_1(n) \leftarrow x_1(n) - x_1(n-1)$$

In step T2, relatively high-precision non-linear conversion (precision is higher than that in conversion in step S108 in FIG. 9) is performed to obtain a non-linear difference array $\{d_H(n)\}$. This can be obtained as follows:

$$d_H(n) \leftarrow f_H(l_1(n))$$

where $f_H(\ )$ represents a relatively high-precision non-linear conversion function. By this conversion, the data space is changed from the linear space to the non-linear space.

In step T3, scaling processing is performed using an appropriate scaling ratio (e.g., a compression ratio for converting a maximum value dHmax of an absolute value $|d_H(n)|$ into a maximum value having a limited number of bits) depending on the waveform data array to form a compressed non-linear difference array $\{d_C(n)\}$ having a limited number of bits. If the scaling ratio is $B/d_H max$ (corresponding to a case wherein a=1 without clipping is used as the parameter a), then the compressed non-linear difference data $d_C(n)$ is obtained as follows:

$$d_C(n) \leftarrow (B/d_H max) \cdot d_H(n)$$

where $d_C(n)$ has a smaller number of bits than that of $d_H(n)$.

The obtained compressed non-linear difference array $\{d_C(n)\}$ is stored in an appropriate memory in step T4.

In the reproduction system, in step T5, the compressed non-linear difference data array is expanded to reproduce a non-linear difference data array $(d'_H(n)\}$. This expansion processing is performed such that a reciprocal value of the compressed ratio used in the recording system is used as an expansion ratio and is multiplied with each compressed non-linear difference data $d_C(n)$. For example, if the compression scaling ratio is $B/d_H max$, the expansion ratio is $d_H max/B$. Each reproduced non-linear difference data $d'_H(n)$ obtained as follows:

$$d'_H(n) \leftarrow (d_H max/B) \cdot d_C(n)$$

The data $d'_H(n)$ has a larger number of bits than that of the data $d_C(n)$.

In step T6, relatively high-precision reverse conversion (precision is higher than the reverse function in the conversion memory 300 in FIG. 11) to reproduce a linear difference array $\{l'_1(n)\}$. By this reverse conversion, the data space is changed from the non-linear space to the linear space. When data of the linear difference array $\{l'_1(n)\}$ is accumulated as shown in step T7, the normalized linear waveform data array is reproduced.

Numerical precision will be exemplified below. The normalized linear waveform data array is a 16-bit data array within the range of ±15 bits, the linear difference array $\{l_1(n)\}$is a 16-bit data array, the non-linear difference array $\{d_H(n)\}$ is a 16-bit data array (therefore non-linear conversion in step T2 is 16/16-bit precision), the reproduced non-linear difference array $\{d'_H(n)\}$ is a 16-bit data array, the reproduced linear difference array $\{l'_1(n)\}$ is a 16-bit data array (therefore reverse conversion in step T6 is 16/16-bit precision), and the reproduced normalized linear waveform data array is a 16-bit data array in the range of ±15 bits.

The conventional non-linear difference scheme will be described with reference to the scheme shown in FIG. 13. In the conventional non-linear difference scheme instead of performing processing (16/16-bit non-linear conversion) in step T2 and processing (variable scaling) in step T3 in FIG. 13, 16/8-bit non-linear conversion processing is performed. Instead of processing (variable expansion) in step T5 and processing (16/16-bit reverse conversion) in step T6 in FIG. 13, 8/16-bit reverse conversion processing is performed. The 16/8-bit non-linear conversion processing can be regarded to consist of 16/16-bit non-linear conversion processing and fixed compression scaling processing taking upper significant eight bits of the 16-bit non-linear data. Similarly, the 8/16-bit reverse conversion processing can be regarded to consist of fixed expansion processing for forming 16-bit non-liner data using 8-bit non-linear data as upper significant eight bits and reverse conversion processing for performing 16/16-bit reverse conversion using the 16-bit non-linear data, i.e., the processed result, as an input. Therefore, in the conventional non-linear difference scheme, information of the lower significant eight bits of the 16-bit non-linear data is basically neglected regardless of the types of waveform data. The range of the 8-bit non-linear difference array obtained by the fixed scaling processing depends on the types of waveform data. For example, if the maximum value of elements of such an 8-bit non-linear difference array is given as 63, the actual range of this 8-bit non-linear difference array is ±6 bits. The significant bit length is not an 8-bit length but only a 7-bit length. For example, an element having a value which is 1/128 the maximum value of 63 is close to 0.5. However, by the fixed scaling processing, this element in the 8-bit non-linear difference array becomes zero (rounded off or rounded). As is apparent from the above description, reproducibility of the conventional non-linear difference scheme is not optimal and is found to largely vary depending on the types of waveforms.

To the contrary, in the scheme of the present invention shown in FIG. 13, fixed scaling processing is not used during recording, but variable compression scaling processing using a compression scaling ratio depending on the types of waveforms is performed. In reproduction, fixed expansion processing is not used, but variable expansion processing using an expansion ratio depending on the types of waveforms is performed instead. Therefore, the range of the 8-bit non-linear difference array as an output in the compression scaling process of step T3 can be normalized to the range of ±7 bits regardless of the types of waveforms, thereby assuring the 8-bit significant bit length. A reproduced waveform having better reproducibility than that of the conventional non-linear difference scheme can be obtained. In particular, reproducibility of waveform portions having small variations can be improved.

The numerical precision described above with reference to FIG. 13 is only an example. The number of bits of an input in non-linear conversion of step T2 need not be equal to that of an output. Similarly, the number of bits of an input in reverse conversion in step T6 need not be equal to that of an output. In particular, in the reverse conversion in step T6, since a reverse conversion memory is generally used to perform high-speed processing, the number of bits of the input must be minimized within a practical range which does not lose the effect of the present invention, thereby reducing the storage capacity of the reverse conversion memory.

For example, assume that the minimum value of a maximum element of the 16-bit linear difference data array $\{l_1(n)\}$ is 1,000 (i.e., about 1/32 the full-range value). Also assume that the logarithmic function ($\mu=200$) shown in equation (5) is used. In this case, first, conversion precision of this logarithmic function is given as 16/16-bit precision. In this case, the value of the converted 16-bit non-linear data is 47×256 with respect to the input data value of 1,000. This 16-bit non-linear data array is converted into an 8-bit compressed non-linear difference data array having a range of a maximum of ±128 steps by the variable compression scaling process in step T3. The lower bits of the 16-bit non-linear difference data do not influence the value of the 8-bit compressed non-linear difference data in practice. That is, the non-linear difference data does not require 16 bits, but can be expressed as 11-bit data. That is, as far as the waveform data array having a maximum element value of 1,000 or less in the 16-bit linear difference data array $\{l_1(n)\}$ is used, conversion precision in non-linear conversion (logarithmic conversion) in step T2 can be 16/11-bit precision. Similarly, processing of reverse conversion (exponential conversion) in step T6 can be performed by using a 11/16-bit conversion memory. Alternatively, the initial numerical precision may be kept unchanged until the expansion process in step T5. 16-bit data as an output in the expansion process in step T5 may be rounded to 11-bit data, and its value may be used to access the 11/16-bit conversion memory. In addition, a sign bit of the 11-bit reproduced non-linear data may be utilized to obtain a 10/15-bit conversion memory. For example, when a two's complement is used as a binary number lower 10 bits of the 11-bit reproduced non-linear data may be converted into 10-bit data in a positive expression (with respect to negative data) by two's complement processing of the sign bit (i.e., MSB). The resulting 10-bit data may be used to access the conversion memory to obtain positive 15-bit data. Two's complement processing is performed for this 15-bit data again by using the sign bit, so that a sign bit is added to data (negative data), thereby reproducing 16-bit linear difference data.

When scaling processing is performed at a compression ratio $a\cdot(B/d_H\max)$ depending on the waveform data array in the non-linear space, clipping occurs if $a>1$. Scaling processing with clipping degrades reproducibility of a waveform portion having a large variation. However, reproducibility of a waveform portion having a small variation can be further improved. The compressed non-linear difference data $d_C(n)$ at this scaling ratio is given as follows:

$$d_C(n) = a \cdot (B/d_H\max) \cdot A \tag{7}$$

$$A = f_H\left[\sum_{k=0}^{n} l_1(k) - \sum_{k=0}^{n-1} f_H^{-1}\{(d_{Hmax}/a \cdot B) \cdot d_C(k)\}\right] \tag{8}$$

Figure 14:
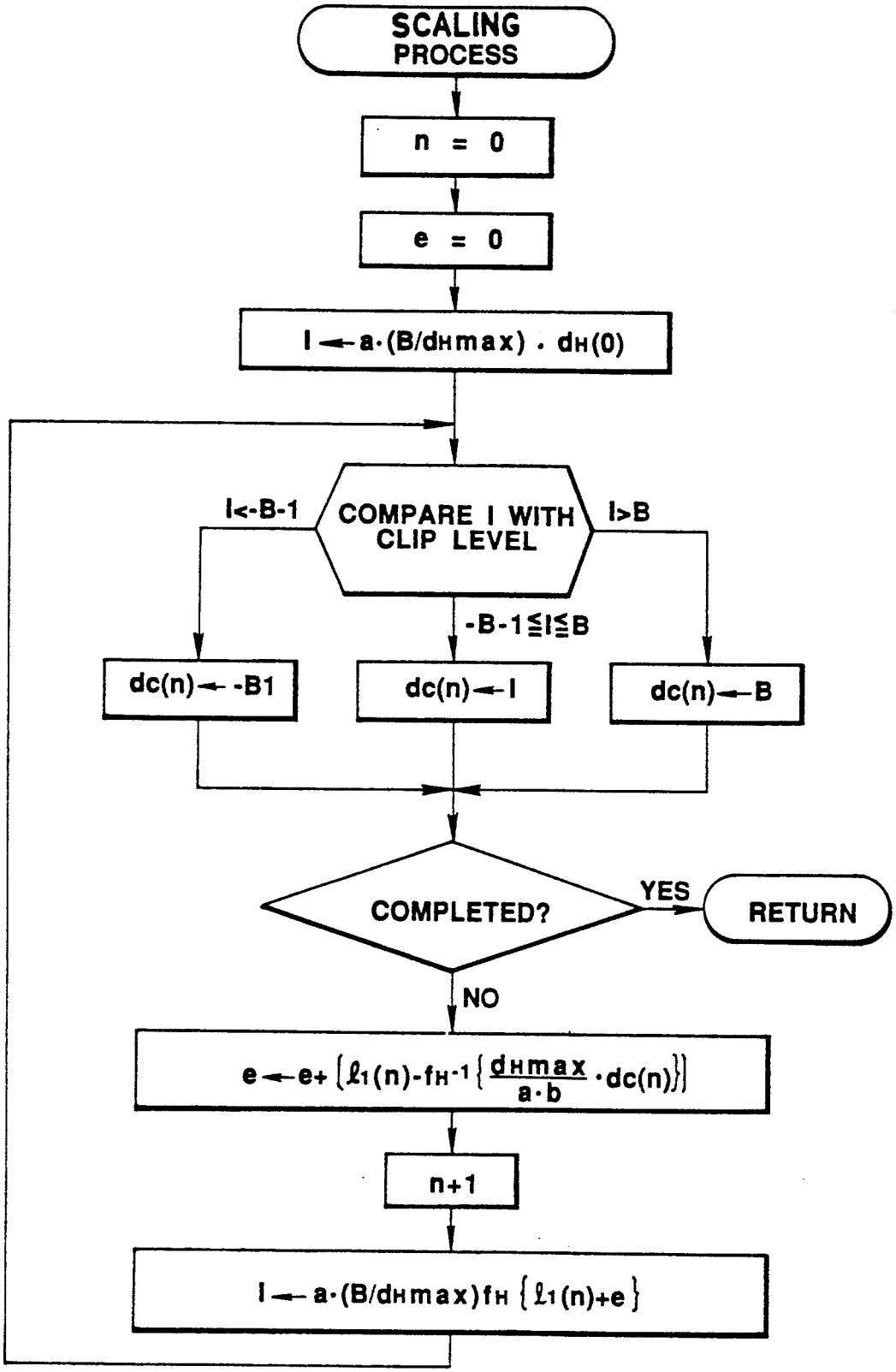
FIG. 14 is a flow chart of clipped compression scaling processing.
Figure 15:
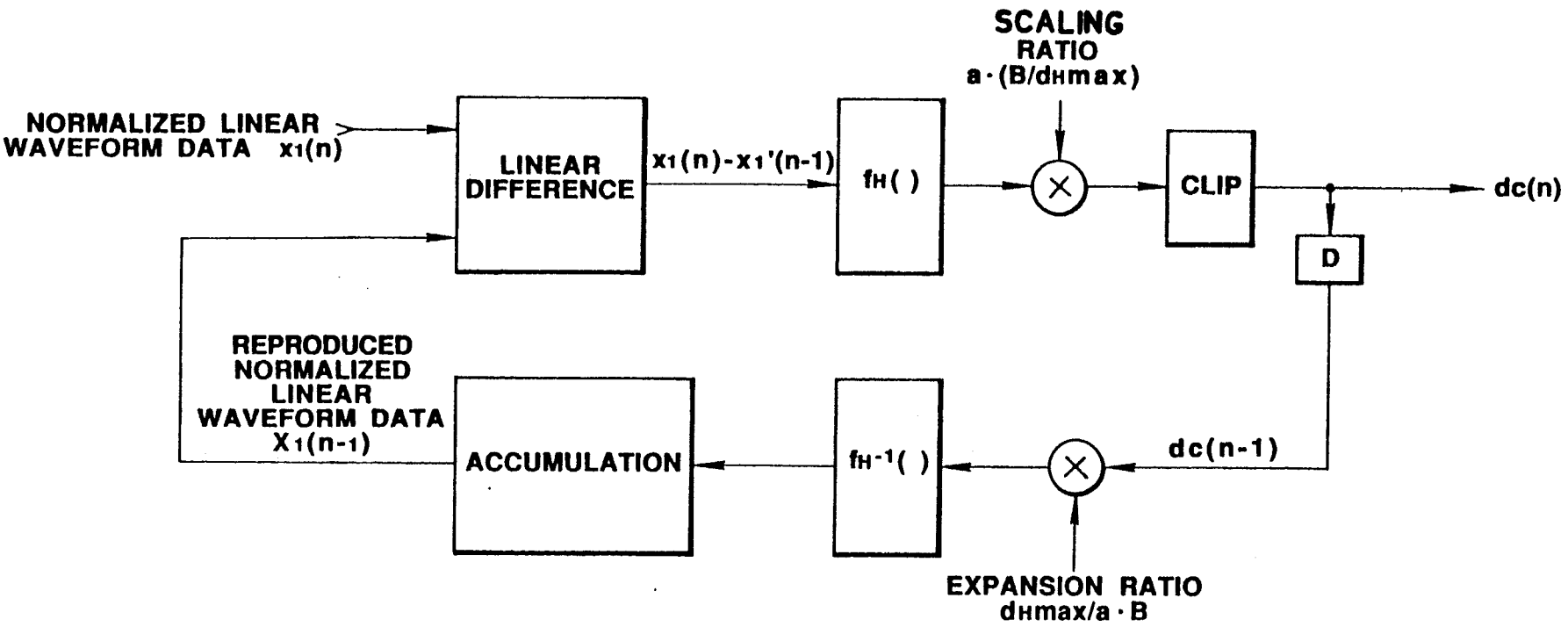
FIG. 15 is a functional block diagram for converting a linear waveform data array into a compressed non-linear difference data array in consideration of generation of a clip in the waveform recording method for performing compression scaling depending on the waveform data array within the non-linear space.
Figure 16:
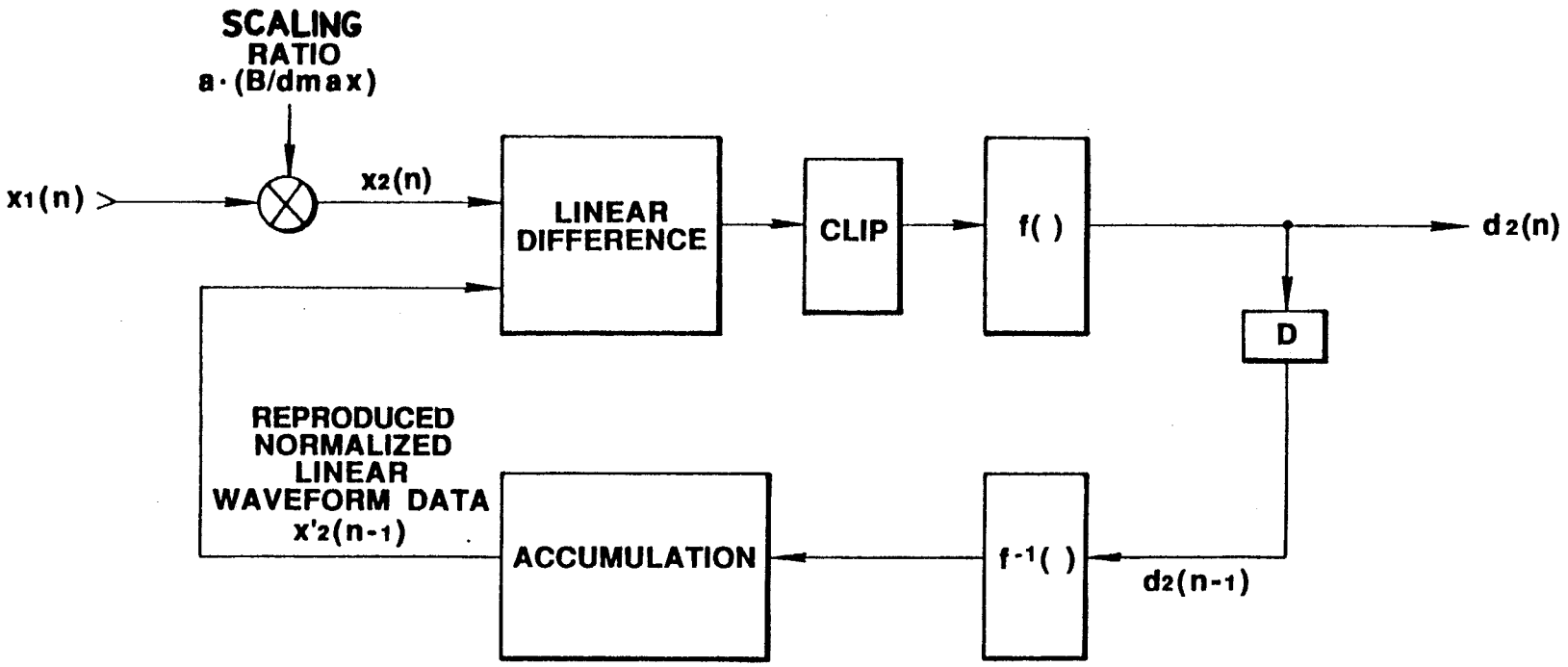
FIG. 16 is a functional block diagram for converting a linear waveform data array into a compressed non-linear difference data array in consideration of generation of a clip in the waveform recording method for performing compression scaling depending on the waveform data array within the linear space.

When the value of the right-hand side of equation (7) is smaller than $-B-1$, $d_C(n)$ is clipped to $-B-1$. However, the value of the right-hand side of equation (7) is larger than $-B-1$, $d_C(n)$ is clipped to B. If $a\leqq 1$, then $A=d_H(n)$ is obtained. The term $$\sum_{k=0}^{n} l_1(k)$$

in equation (8) represents the nth element $x_2(n)$ of the linear waveform data array normalized in the recording system. The term $$\sum_{k=0}^{n-1} f_H^{-1}\{(d_H\max/a \cdot B) \cdot d_C(k)\}$$

represents the (n−1)th element $x_2'$ (n−1) of the normalized linear waveform data array to be reproduced by the reproduction system. Equation (8) is a mathematical expression for non-linearly converting the linear difference between the $x_2(n)$ and $x_2'$ (n−1) in accordance with the non-linear function $f_H(\ )$. Equation (7) is a mathematical expression for multiplying (and the product is selectively clipped) the scaling ratio $a \cdot (B/d_H\max)$ with the non-linear difference as a result of equation (8). For a further reference, a compression scaling processing flow for forming the compressed non-linear difference data array $\{d_C(n)\}$ is shown in FIG. 14. If $a \leqq 1$, then clipping does not occur. The value e always satisfies condition $e=0$, and $f_H\{l_1(n)+e\}=f_H\{l_1(n)\}=d_H(n)$ is established. Similarly, FIG. 15 shows a functional block diagram for converting the normalized linear waveform data array $\{x_1(n)\}$ into the compressed non-linear difference data array $\{d_C(n)\}$ in accordance with equations (7) and (8) FIG. 16 shows a functional block diagram for converting the normalized linear waveform data array $\{x_1(n)\}$ into the compressed non-linear difference data array $\}d_2(n)\}$ in the waveform recording/reproduction method for performing scaling within the linear space (this corresponds to the operations in steps S107 and S108 in FIG. 9).

Figure 17:
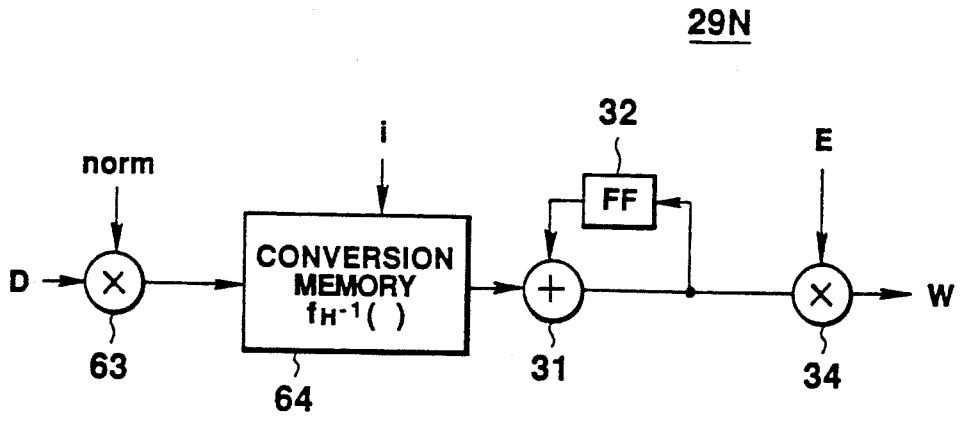
FIG. 17 is a block diagram of a waveform generator using a waveform reproduction method shown in FIG. 13.

A waveform generator (FIG. 13) for performing waveform reproduction is represented by reference numeral 29N in FIG. 17. This waveform generator 29N is operated as follows. In the waveform generator 29N, the compressed non-linear difference data D from the difference waveform memory which stores the waveform information in accordance with the waveform recording method described with reference to FIG. 13 is multiplied with the expansion ratio norm (i.e., a reciprocal value of the scaling ratio of the recording system) by a multiplier 63. The product is supplied to a conversion memory 64 for storing a reverse function $f_H^{-1}(\ )$ of the recording non-linear function to reproduce linear difference data. This linear difference data is supplied to an accumulator consisting of an adder 31 and an FF 32 to reproduce normalized waveform data. The envelope data E is multiplied with the normalized waveform data by a multiplier 34 to obtain an envelope-added musical tone waveform W. The waveform generator 29N is different from the waveform generator 29 in FIG. 11 in that a multiplication (expansion) of the expansion ratio norm is performed on the direct path of the linear space in FIG. 11, but this multiplication is performed on the direct path in the non-linear space in FIG. 17.

THIRD EMBODIMENT

A digital filter for performing desired processing of a waveform data array is arranged in a waveform generator 29.

Figure 18:
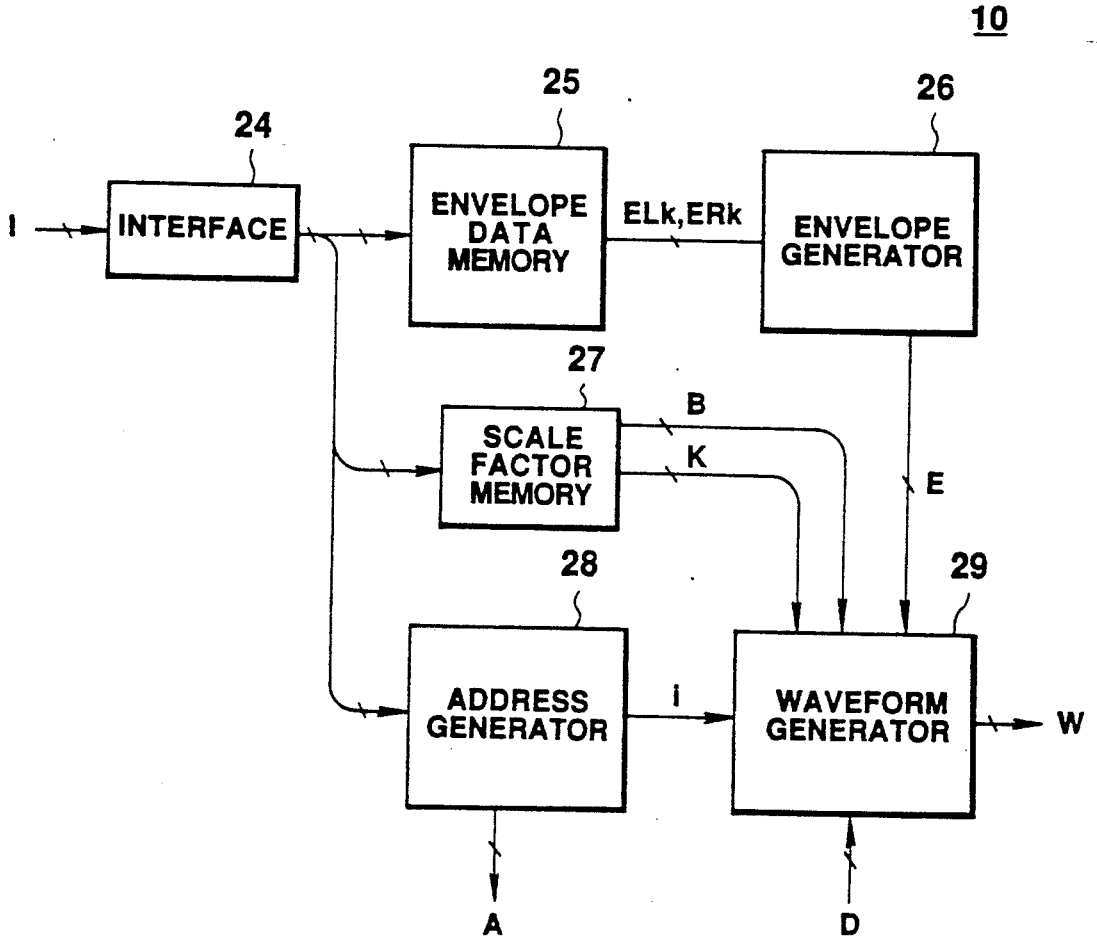
FIG. 18 is a block diagram showing an arrangement of a tone generator according to the third embodiment of the present invention.

FIG. 18 shows an arrangement of a tone generator 10 which is similar to that described in each previous embodiment. A scale factor memory 27 stores scale factors K and B used in the waveform generator 29. The scale factor K has a value obtained by multiplying a filter gain coefficient with the expansion ratio norm. The scale factor B represents a filter coefficient of 1 or more except for the filter gain coefficient used in digital filtering processing in the waveform generator 29. When a linear IIR digital filter shown in FIGS. 20 and 21 (to be described later) is arranged in the waveform generator 29, the scale factor B is one parameter and represents a feedback coefficient. The waveform generator 29 serves as a waveform generating means for generating a waveform in accordance with the present invention. In response to an increment signal from an address generator 28, the waveform generator 29 generates a musical tone waveform W by using compressed difference data D from a difference waveform memory 11, the scale factors K and B from the scale factor memory 27, and an envelope data E from an envelope generator 26.

Figure 19:
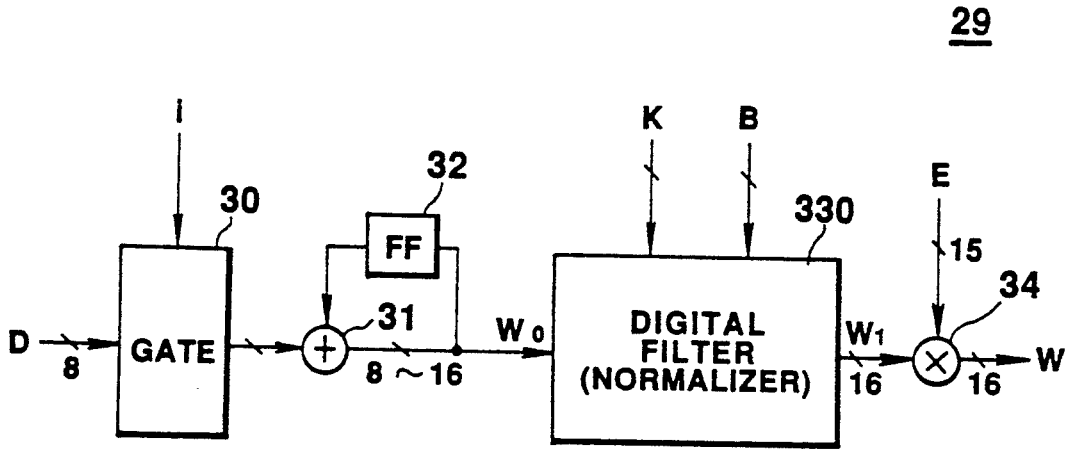
FIG. 19 is a block diagram showing an arrangement wherein a digital filter is incorporated in the waveform generator 29 in FIG. 5.

FIG. 19 shows a function of the waveform generator 29. A gate 30 gates and sends the compressed difference data D (e.g., 8-bit data) to an accumulator (accumulating means) constituted by an adder 31 and an FF 32 when the increment signal i is received, i.e., when the address A is updated and the compressed difference data from the difference waveform memory 11 is updated. The accumulator accumulates the compressed difference data D to generate waveform data (accumulation output) of 8 to 16 bits. This accumulation output $W_0$ represents an accumulation value of the compressed difference data, i.e., the compressed reproduced waveform data.

When the expansion ratio norm is multiplied with this accumulation output, the reproduced waveform data whose range is normalized within the range of ±15 bits can be obtained. In addition, when the normalized reproduced waveform data is digitally filtered with a filter coefficient such as a filter gain coefficient, waveform data whose tone color or the like is processed is obtained. According to this method, however, the expansion ratio multiplication for normalization and the filter gain coefficient multiplication for filtering processing must be independently performed, so that the load of the waveform generator 29 is increased. For example, if a polyphonic count of the waveform generator 29 is defined as N, 2N multiplications must be performed every sampling period.

In this embodiment, a digital filter 330 for performing normalization and digital filtering processing is arranged in the waveform generator 29.

Figure 20:
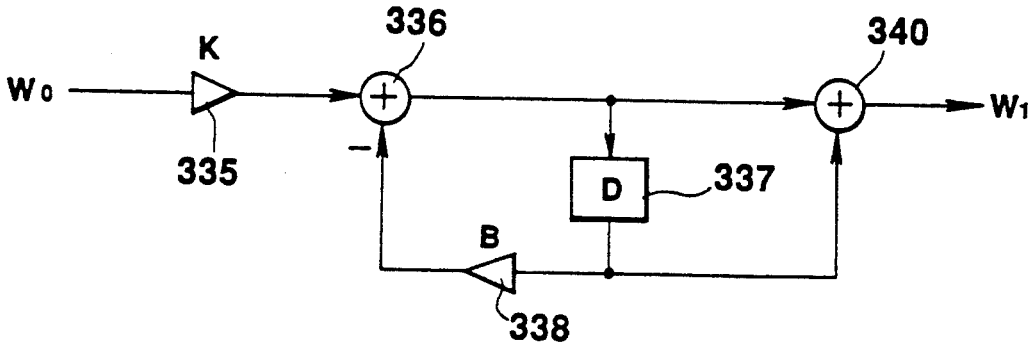
FIG. 20 is a block diagram of a low-pass filter as an arrangement of a digital filter shown in FIG. 19.
Figure 21:
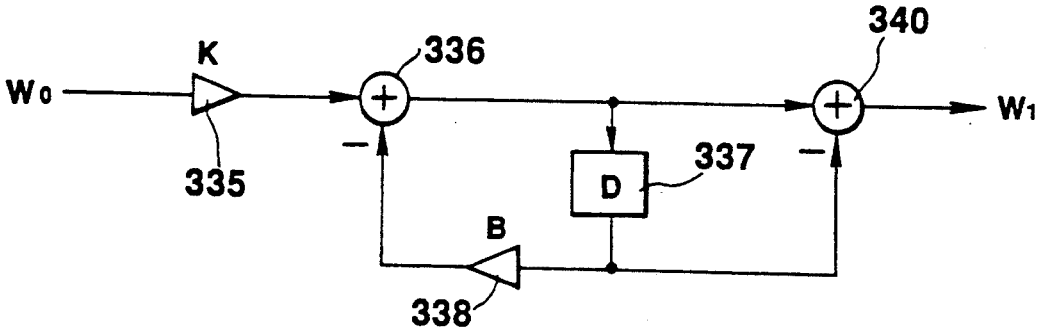
FIG. 21 is a block diagram of a high-pass filter as another arrangement of the digital filter shown in FIG. 19.

FIGS. 20 and 21 show a function of the digital filter 330 of FIG. 19. In this case, a linear IIR filter is used as the digital filter. However, the number of degrees and filter characteristics are not limited to specific ones in the present application. FIG. 20 shows a linear LPF logic arrangement, while FIG. 21 shows an HPF logic arrangement. Either arrangement comprises an input multiplier 335, an adder 336, a delay unit 337, a feedback multiplier 338, and an adder 340.

It should be noted that the input multiplier 335 multiplies the input data $W_0$ with the scale factor K, i.e., a scale factor corresponding to a value obtained by multiplying a filter gain coefficient (to be referred to as K') with the expansion ratio norm. This indicates that two multiplications, i.e., $W_0$ x norm and $K' \times (W0 \times \text{norm})$ can be realized by one multiplication $K \times W_0$ by a hardware multiplier for independently or simultaneously performing the above two multiplications.

For the sake of descriptive convenience, normalization processing and digital filtering processing will be separately described. The normalization processing is processing for performing the multiplication as $W_0 \times norm'$ and the digital filtering processing is processing using the filter gain coefficient K' and the feedback coefficient B. A transfer function in digital filtering processing is obtained for an LPF as follows:

$$H_L(Z) = K' \cdot \frac{1 + Z^{-1}}{1 + BZ^{-1}}$$

and for an HPF as follows:

$$H_H(Z) = K' \cdot \frac{1 - Z^{-1}}{1 + BZ^{-1}}$$

If Butterworth filter characteristics are selected, the following conditions are satisfied:

$$B=(\alpha-1)/(\alpha+1)$$

$$K'=(1+B)/2$$

$$\alpha=\tan(\pi fc/fs)$$

where fc is the cutoff frequency and fs is the sampling frequency.

In an electronic musical instrument, it is often desired to change the cutoff frequency fc in accordance with an input at a performance operation element. In this case, the microcomputer 8 shown in FIG. 4 obtains cutoff frequency information from the operation input and obtains the feedback coefficient B and the filter gain coefficient K' by using a conversion table on the basis of the input cutoff frequency information. The microcomputer 8 stores the expansion ratio norm and multiplies the expansion coefficient norm with the filter gain coefficient K' to obtain the scale factor K. The resulting scale factors K and B are set in the scale factor memory 27 in the tone generator 10 and are used in the normalization digital filter 330 in the waveform generator 29.

When the processing in FIG. 20 and 21 is performed, normalization of the reproduced waveform data by the expansion ratio norm and the digital filtering processing by the filter gain coefficient K' and the feedback coefficient B are simultaneously performed. In particular, the multiplication of the expansion ratio norm and the multiplication of the filter gain coefficient K' are simultaneously performed by one multiplication indicated by reference numeral 355, thereby reducing the required number of multiplications.

Referring back to FIG. 19, waveform data $W_1$ whose tone color is processed and output from the digital filter 330 is multiplied with the envelope data E from the envelope generator 26 by the multiplier 34, thereby obtaining the final musical tone waveform output W.

This invention has been described above. Various changes and modifications may be made within the spirit and scope of the invention.

For example, the orders of processing operations in the waveform generator 29 are not limited to the ones shown in FIG. 19 and FIGS. 20 and 21. Therefore, processing for the multiplication of the scale factor K can be executed in an appropriate stage. If desired, envelope data corresponding to (E×K) may be generated by the envelope generator 26, and this envelope data is multiplied with the data in an appropriate stage. Then, the envelope multiplication indicated by reference numeral 34 and the scale factor multiplication indicated by reference numerals 335 can be simultaneously performed by one multiplication operation.

In the above embodiment, in order to improve reproducibility at a low volume level, the envelope is removed from the waveform in the recording system. In the reproduction system, the envelope is added to the waveform. If desired, these processing operations can be omitted. In addition, the envelope may not be removed by the recording system, and may be added by the reproduction system.

The expansion ratio norm is not necessarily a reciprocal value of the scaling ratio but may be a value close to the reciprocal value.

The present invention has been exemplified by several preferred embodiments in detail. These embodiments are merely illustrated as examples. Various arrangements may be employed in the present invention. All modifications and applications are incorporated in the present invention without departing from the spirit and scope of the invention, the appended claims, and their equivalents.

What is claimed is:

1. A method of recording/reproducing a waveform, comprising the steps of:

providing a waveform data array representing an audio signal;

determining a constant scaling ratio, which is not changed from generation start to generation end of the waveform, in dependence on a magnitude of a variation of the waveform data array;

forming a scaled data array from the waveform data array on the basis of said scaling ratio;

forming a scaled difference data array from the scaled data array;

storing the scaled difference data array;

storing expansion ratio data representing an expansion ratio associated with the scaling ratio; and reproducing a waveform data array from the stored scaled difference data array on the basis of the stored expansion ratio data.

2. An apparatus for reproducing a waveform, comprising:

scaled difference data array memory means for storing a scaled difference data array scaled at a constant scaled ratio, which is not changed from generation start to generation end of the waveform, in dependence on a magnitude of a variation of a waveform data array representing an audio signal;

expansion ratio data memory means for storing expansion ratio data representing an expansion ratio associated with the scaled ratio; and means for reproducing a waveform data array representing the audio signal on the basis of the scaled difference data array and the expansion ratio data.

3. An apparatus according to claim 2, wherein said reproducing means comprises:

means for accumulating scaled difference data arrays read out from said scaled difference data array memory means and forming an accumulation output; and means for multiplying the accumulation output from said accumulating means with the expansion ratio data.

4. A method of recording/reproducing a waveform, comprising the steps of:

providing a waveform data array representing an original audio signal;

extracting an envelope from the waveform data array;

normalizing the waveform data array by the extracted envelope to form a normalized waveform data array;

determining a constant scaling ratio, which is not changed from generation start to generation end of the waveform, in dependence on a magnitude of a variation of the normalized waveform data array;

forming a scaled data array from the normalized waveform data array on the basis of said scaled ratio;

forming a scaled difference data array from the scaled data array;

storing the scaled difference data array;

storing expansion ratio data representing an expansion ratio associated with the scaled ratio;

generating a predetermined envelope; and reproducing a waveform data array on the basis of the stored compressed scaled data, the expansion ratio data, and the predetermined envelope.

5. An apparatus for reproducing a waveform, comprising:

scaled difference data array memory means for storing a scaled difference data array scaled at a constant scaling ratio, which is not changed from generation start to generation end of the waveform, in dependence on a magnitude of a variation of a normalized waveform data array normalized by an envelope of an audio signal;

expansion ratio data memory means for storing expansion ratio data representing an expansion ratio associated with the scaling ratio;

envelope generating means for generating a predetermined envelope; and means for reproducing a waveform data array on the basis of the scaled difference data array, the expansion ratio, and the envelope.

6. An apparatus for reproducing a waveform, comprising:

scaled difference data array memory means for storing a scaled difference data array scaled at a constant scaling ratio which is not changed form generation start to generation end of the waveform and which is determined in dependence on a magnitude of a variation of a normalized waveform data array normalized by an envelope of an audio signal;

envelope generating means for generating an envelope expanded at an expansion ratio associated with the scaling ratio;

means for accumulating scaled difference data arrays from said scaled difference data array memory means; and means for multiplying an accumulation output from said accumulating means with the envelope from said envelope generating means and reproducing a waveform data array.

7. An apparatus for reproducing a waveform, comprising:

difference data array memory means for storing a plurality of difference data arrays;

scale factor memory means for storing a plurality of constant scale factors which are not changed from generation start to generation end of the waveform and which correspond to the respective difference data arrays stored in said difference data array memory means; and means for reproducing the waveform data array representing an audio signal on the basis of the difference data array from said difference data array memory means and the scale factor from said scale factor memory means, the scale factor corresponding to this difference data array.

8. An apparatus according to claim 7, wherein said reproducing means comprises:

means for accumulating difference data of the difference data array; and means for multiplying the scale factor corresponding to the difference data array with an accumulation output from said accumulating means.

9. A method of recording/reproducing a waveform, comprising:

providing a waveform data array representing an audio signal;

generating a scaled data array having a normalized range from the waveform data array of the basis of a constant scaling ratio which is not changed form generation start to generation end of the waveform and which is determined in dependence on the waveform data array;

forming a scaled non-linear difference data array from the scaled data array on the basis of a predetermined non-linear function;

storing the scaled nonlinear difference data array;

storing an expansion ratio associated with the scaling ratio; and reproducing a waveform data array from the stored scaled non-linear difference data array on the basis of a reciprocal function of the non-linear function and the stored expansion ratio.

10. A method of recording/reproducing a waveform, comprising:

providing a waveform data array representing an audio signal;

generating a scaled data array having a normalized range from the waveform data array on the basis of:

a predetermined non-linear function, and a constant scaling ratio which is not changed from generation start to generation end of the waveform and which is determined in dependence on the waveform data array;

generating a scaled non-linear difference data array from the scaled data array on the basis of a predetermined non-linear function;

storing the scaled nonlinear difference data array;

storing an expansion ratio associated with the scaling ratio; and reproducing a waveform data array from the stored scaled non-linear difference data array on the basis of a reciprocal function of the non-linear function and the stored expansion ratio:

wherein the scaled non-linear difference data array generating step comprises the steps of:

scaling the waveform data array in accordance with the scaling ratio and generating the scaled waveform data array whose range is normalized, and converting the scaled waveform data array into the scaled non-linear difference data array having a limited number of bits in accordance with the non-linear function; and the reproducing step comprises the steps of:

converting the scaled non-linear difference data array into a reproduced scaled waveform data array in accordance with the reverse function, and expanding the reproduced scaled waveform data array in accordance with the expansion ratio to generate a reproduced waveform data array.

11. A method of recording/reproducing a waveform, comprising:

providing a waveform data array representing an audio signal;

generating a scaled data having a normalized range from the waveform data array on the basis of:

a predetermined non-linear function, and a constant scaling ratio which is not changed from generation start to generation end of the waveform and which is determined in dependence on the waveform data array;

generating a scaled non-linear difference data array from the scaled data array on the basis of a predetermined non-linear function;

storing the scaled nonlinear difference data array;

storing an expansion ratio associated with the scaling ratio; and reproducing a waveform data array from the stored scaled non-linear difference data array on the basis of a reciprocal function of the non-linear function and the stored expansion ratio;

wherein the scaled non-linear difference data array generating step comprises the steps of:

changing the waveform data array into the non-linear difference data array in accordance with the non-linear function, and generating the scaled non-linear difference data array normalized with respect to a limited number of bits obtained by scaling the non-linear difference data array in accordance with the scaling ratio; and the reproducing step comprises the steps of:

expanding the scaled non-linear difference data array in accordance with the expansion ratio to generate a reproduced non-linear difference data array, and converting the reproduced non-linear difference data array into a reproduced waveform data array in accordance with the reverse function.

12. An apparatus for reproducing a waveform, comprising:

scaled non-linear data memory means for storing a scaled non-linear difference data array scaled by a constant scaling ratio which is not changed from generation start to generation end of the waveform and which is determined in dependence on waveform data representing an audio signal and non-linearly converted in accordance with a predetermined non-linear function;

expansion ratio memory means for storing an expansion ratio associated with the scaling ratio; and reproducing means for reproducing a waveform data array representing the audio signal from the scaled non-linear difference data array on the basis of a reverse function of the non-linear function and the expansion ratio.

13. An apparatus according to claim 12, wherein said reproducing means comprises:

means for converting the scaled non-linear difference data array into a reproduced scaled waveform data array in accordance with the reverse function; and means for expanding the reproduced scaled waveform data array in accordance with the expansion ratio to generate a reproduced waveform data array.

14. An apparatus according to claim 12, wherein said reproducing means comprises:

means for expanding the scaled non-linear difference data array in accordance with the expansion ratio to generate a non-linear difference data array; and means for converting the non-linear difference data array into a waveform data array in accordance with the reverse function.

15. A method of recording/reproducing a waveform, comprising:

providing a waveform data array representing an original audio signal;

extracting an envelope from the waveform data array;

normalizing the waveform data array in accordance with the extracted envelope to generate a normalized waveform data array free from the envelope;

generating a scaled data array from the normalized waveform data array on the basis of a constant scaling ratio which is not changed from generation start to generation end of the waveform and which is determined in dependence on the normalized waveform data array;

forming a scaled non-linear difference data array from the scaled data array on the basis of a predetermined non-linear function;

storing the scaled non-linear difference data array;

storing an expansion ratio associated with the scaling ratio;

generating a predetermined envelope; and reproducing a waveform data array from the stored scaled non-linear difference data array on the basis of a reverse function of the non-linear function, the stored expansion ratio, and the predetermined envelope.

16. An apparatus for reproducing a waveform, comprising:

scaled non-linear difference data array memory means for storing a scaled non-linear difference data array scaled at a constant scaling ratio which is not changed from generation start to generation end of the waveform and is determined in dependence on a normalized waveform data array representing an audio signal free from an envelope and non-linearly converted in accordance with a predetermined non-linear function;

expansion ratio memory means for storing an expansion ratio associated with the scaling ratio;

envelope generating means for generating a predetermined envelope; and reproducing means for reproducing a waveform data array from the scaled non-linear difference data array on the basis of a reverse function of the non-linear function, the expansion ratio, and the predetermined envelope.

17. An apparatus for reproducing a waveform, comprising:

scaled non-linear difference data array memory means for storing a scaled non-linear difference data array scaled at a constant scaling ratio which is not changed from generation start to generation end of the waveform and is determined in dependence on a normalized waveform data array representing an audio signal free from an envelope and non-linearly converted in accordance with a predetermined non-linear function; and waveform reproducing means for reproducing a waveform data array from the scaled non-linear difference data array, said waveform reproducing means comprising:

means for converting the scaled non-linear difference data array into a scaled normalized waveform data array in accordance with a reverse function of the non-linear function, envelope generating means for generating an envelope expanded at an expansion ratio associated with the scaling ratio, and means for multiplying the expanded envelope with the scaled normalized waveform data array.

18. An apparatus for generating a waveform, comprising:

scaled difference data array memory means for storing a scaled difference data array scaled at a constant scaling ratio which is not changed from generation start to generation end of the waveform and is determined in dependence on a magnitude of a variation of a waveform data array representing an audio signal;

waveform reproducing means for reading out the scaled difference data from said scaled difference data array memory means and reproducing the waveform data;

digital filter means for performing digital filtering of the waveform data output from said waveform reproducing means; and scale factor memory means for storing a scale factor obtained by multiplying a gain coefficient associated with the filtering of said digital filtering means with an expansion ratio, associated with the scaling ratio, for normalizing a range of waveform data reproduced from said waveform reproducing means, said digital filter means including means for multiplying the scale factor from said scale factor memory means with the waveform data reproduced by said waveform reproducing means.

19. An apparatus for generating a waveform, comprising:

scaled difference data array memory means for storing a scaled difference data array scaled at a constant scaling ratio which is not changed from generation start to generation end of the waveform and is determined in dependence on a magnitude of a variation of a waveform data array representing an audio signal;

scale factor memory mans for storing a scale factor having a value obtained by multiplying a filter gain coefficient associated with digital filtering processing for tone color processing of the waveform data array with an expansion ratio, associated with the scaling ratio, for normalizing a range of the waveform data array for reproducing the waveform data array; and waveform generating means for processing the scaled difference data array from said scaled difference data array memory means to generate a tone-color-processed waveform data array so as to achieve reproduction of the waveform data array on the basis of the scaled difference data array and the expansion ratio and so as to achieve digital filtering processing having the filter gain coefficient for the waveform data array;

said waveform generating means including multiplying means for simultaneously performing a multiplication of the expansion ratio for normalizing the range of the waveform data array and a multiplication of the filter gain coefficient associated with the digital filtering processing by means of one multiplication using the scale factor from said scale factor memory means as a multiplier.

* * * * *